US012330845B2

(12) United States Patent
Tost et al.

(10) Patent No.: US 12,330,845 B2
(45) Date of Patent: Jun. 17, 2025

(54) DAMAGE-RESISTANT PACKAGING BOX FOR SHIPPING PLANAR ARTICLES

(71) Applicant: Movie Mars, Inc., Indian Trail, NC (US)

(72) Inventors: Gregory T. Tost, Indian Trail, NC (US); Daniel E-Lee Yen, Waxhaw, NC (US); Brian E. Marzano, Monroe, NC (US)

(73) Assignee: Movie Mars, Inc., Indian Trail, NC (US)

( * ) Notice: Subject to any disclaimer, the term of this patent is extended or adjusted under 35 U.S.C. 154(b) by 115 days.

(21) Appl. No.: 18/105,070

(22) Filed: Feb. 2, 2023

(65) Prior Publication Data

US 2024/0190606 A1 Jun. 13, 2024

Related U.S. Application Data

(63) Continuation-in-part of application No. 29/862,224, filed on Dec. 7, 2022.

(51) Int. Cl.
*B65D 5/50* (2006.01)
*B65D 5/02* (2006.01)
(Continued)

(52) U.S. Cl.
CPC ..... *B65D 5/5016* (2013.01); *B65D 5/0236* (2013.01); *B65D 5/541* (2013.01)

(58) Field of Classification Search
CPC .. B65D 1/0215; B65D 1/0223; B65D 1/0246; B65D 1/0261; B65D 1/0292; B65D 1/10;
(Continued)

(56) References Cited

U.S. PATENT DOCUMENTS 2,005,967 A * 6/1935 Berdan ..... B65D 75/38 206/454
2,024,832 A * 12/1935 Myers ..... B65D 27/22 229/152
(Continued)

FOREIGN PATENT DOCUMENTS

AU 2018260918 A1 * 7/2019 ..... B65D 5/3678
FR 3103797 A1 * 6/2021 ..... B65D 5/0254
(Continued)

OTHER PUBLICATIONS

"Optimizing Packaging for an E-commerce World" (American Institute for Packaging and the Environment, Jan. 2017), at https://cdn.ymaws.com/www.ameripen.org/resource/resmgr/.
(Continued)

*Primary Examiner* — Anthony D Stashick
*Assistant Examiner* — Marcos Javier Rodriguez Molina
(74) *Attorney, Agent, or Firm* — Christopher J. Scott

(57) ABSTRACT

A packaging box blank and packaging box configured from the packaging box blank enables a shipper to package substantially planar articles for shipment and includes a base box portion, a pair of opposed side wall flap portions, and a pair of opposed top flap portions. The side wall flap portions extend from laterally opposed side wall attachment portions and the top flap portions extend from top flap attachment portions. The side wall flap portions are firstly folded to cover opposed lateral portions of a substantially planar article received in anterior adjacency to the base box portion. The top flap portions are secondly folded to cover opposed longitudinal portions of the article thereby enclosing the article for shipment. Particularly configured top and bottom corner extensions absorb impact at corners of the packaging box for providing damage resistance thereto as shipped articles move through package delivery systems.

17 Claims, 15 Drawing Sheets

(51) Int. Cl.
*B65D 5/54* (2006.01)
*B65D 75/14* (2006.01)

(58) Field of Classification Search
CPC . B65D 1/14; B65D 1/165; B65D 1/22; B65D 1/26; B65D 1/30; B65D 1/34; B65D 1/36; B65D 1/40; B65D 1/44; B65D 1/46; B65D 11/02; B65D 11/10; B65D 11/12; B65D 11/16; B65D 11/1833; B65D 11/188; B65D 11/22; B65D 11/26; B65D 11/28; B65D 13/00; B65D 13/04; B65D 15/08; B65D 15/22; B65D 17/00; B65D 19/00; B65D 19/0008; B65D 19/0016; B65D 19/0028; B65D 19/04; B65D 19/06; B65D 19/12; B65D 19/14; B65D 19/18; B65D 19/20; B65D 19/38; B65D 19/40; B65D 19/44; B65D 21/02; B65D 21/0201; B65D 21/0202; B65D 21/0205; B65D 21/0209; B65D 21/0212; B65D 21/0213; B65D 21/0222; B65D 21/0223; B65D 21/0233; B65D 21/0235; B65D 21/066; B65D 21/08; B65D 21/083; B65D 2203/00; B65D 2203/06; B65D 2203/10; B65D 2205/00; B65D 2205/02; B65D 2213/00; B65D 2215/00; B65D 2215/04; B65D 2231/02; B65D 2251/0015; B65D 2251/0018; B65D 2251/0025; B65D 2251/0056; B65D 2251/009; B65D 2251/0093; B65D 2251/0096; B65D 2251/105; B65D 2251/20; B65D 2251/205; B65D 23/00; B65D 23/0821; B65D 23/0878; B65D 23/0885; B65D 23/104; B65D 23/14; B65D 2301/10; B65D 2301/20; B65D 2303/00; B65D 2313/00; B65D 2313/02; B65D 2313/10; B65D 2401/00; B65D 2401/05; B65D 2401/15; B65D 2401/25; B65D 2401/30; B65D 2401/35; B65D 2401/40; B65D 25/02; B65D 25/04; B65D 25/08; B65D 25/10; B65D 25/101; B65D 25/102; B65D 25/107; B65D 25/14; B65D 25/16; B65D 25/20; B65D 25/205; B65D 25/22; B65D 25/24; B65D 25/2826; B65D 25/32; B65D 25/34; B65D 25/52; B65D 25/54; B65D 2519/00019; B65D 2519/00024; B65D 2519/00029; B65D 2519/00034; B65D 2519/00039; B65D 2519/00054; B65D 2519/00059; B65D 2519/00064; B65D 2519/00069; B65D 2519/00074; B65D 2519/00094; B65D 2519/00099; B65D 2519/00104; B65D 2519/00109; B65D 2519/00159; B65D 2519/00164; B65D 2519/00174; B65D 2519/00194; B65D 2519/00233; B65D 2519/00273; B65D 2519/00288; B65D 2519/00293; B65D 2519/00303; B65D 2519/00318; B65D 2519/00323; B65D 2519/00333; B65D 2519/00338; B65D 2519/00502; B65D 2519/00517; B65D 2519/00532; B65D 2519/00562; B65D 2519/00572; B65D 2519/00606; B65D 2519/00621; B65D 2519/00656; B65D 2519/00661; B65D 2519/00666; B65D 2519/00691; B65D 2519/00696; B65D 2519/00711; B65D 2519/00731; B65D 2519/00791; B65D 2519/00805; B65D 2519/00815; B65D 2519/0082; B65D 2519/00825; B65D 2519/00875; B65D 2519/00925; B65D 2519/00935; B65D 2519/00995; B65D 2543/00027; B65D 2543/00046; B65D 2543/00074; B65D 2543/00092; B65D 2543/00101; B65D 2543/00111; B65D 2543/00157; B65D 2543/00194; B65D 2543/00222; B65D 2543/0024; B65D 2543/0025; B65D 2543/00268; B65D 2543/00277; B65D 2543/00296; B65D 2543/00351; B65D 2543/00416; B65D 2543/0049; B65D 2543/00509; B65D 2543/00518; B65D 2543/00527; B65D 2543/00537; B65D 2543/00546; B65D 2543/00555; B65D 2543/00564; B65D 2543/00574; B65D 2543/00601; B65D 2543/00638; B65D 2543/00685; B65D 2543/00703; B65D 2543/00712; B65D 2543/00731; B65D 2543/00805; B65D 2543/00814; B65D 2543/00851; B65D 2543/00879; B65D 2543/00972; B65D 2563/101; B65D 2565/383; B65D 2565/384; B65D 2565/385; B65D 2565/387; B65D 2571/00018; B65D 2571/00111; B65D 2571/00141; B65D 2571/00228; B65D 2571/00265; B65D 2571/00339; B65D 2571/00475; B65D 2571/00481; B65D 2571/00561; B65D 2571/00567; B65D 2571/00574; B65D 2571/0066; B65D 2571/00666; B65D 2571/00697; B65D 2571/00728; B65D 2575/3218; B65D 2575/3245; B65D 2577/041; B65D 2577/205; B65D 2577/2083; B65D 2577/2091; B65D 2581/053; B65D 2581/055; B65D 2581/3437; B65D 2581/3452; B65D 2581/3466; B65D 2581/3467; B65D 2581/3472; B65D 2581/3477; B65D 2581/3479; B65D 2581/3494; B65D 2583/00; B65D 2585/00; B65D 2585/366; B65D 2585/545; B65D 2585/648; B65D 2585/649; B65D 2585/6835; B65D 2585/6837; B65D 2585/6882; B65D 2585/6885; B65D 2585/6897; B65D 27/30; B65D 29/04; B65D 3/04; B65D 3/10; B65D 3/16; B65D 31/02; B65D 31/04; B65D 31/16; B65D 33/00; B65D 33/004; B65D 33/01; B65D 33/02; B65D 33/14; B65D 33/24; B65D 33/2508; B65D 33/2516; B65D 33/2541; B65D 33/25865; B65D 33/28; B65D 35/08; B65D 35/36; B65D 35/56; B65D 37/00; B65D 39/00; B65D 41/0407; B65D 41/0414; B65D 41/045; B65D 41/0471; B65D 41/12; B65D 41/125; B65D 41/32; B65D 41/325; B65D 41/34; B65D 41/3428; B65D 41/3442; B65D 43/02; B65D 43/0212; B65D 43/0218; B65D 43/022; B65D 43/0222; B65D 43/0231; B65D 43/065; B65D 43/12; B65D 43/162; B65D 43/163; B65D 43/164; B65D 43/168; B65D 43/26; B65D 43/267; B65D 45/18; B65D 47/06; B65D 47/063; B65D 47/08; B65D 47/0809; B65D 47/0838; B65D 47/0847; B65D 47/0895; B65D 47/148; B65D 47/18; B65D 47/2018; B65D 47/2031; B65D 47/2068; B65D 47/248; B65D 47/265; B65D 47/286; B65D 47/42; B65D 5/00; B65D 5/0005; B65D 5/001; B65D 5/003; B65D 5/0045; B65D 5/008; B65D 5/0209; B65D 5/0236; B65D 5/029; B65D 5/04; B65D 5/06; B65D 5/064; B65D 5/065; B65D 5/067; B65D 5/068; B65D 5/08; B65D 5/10; B65D 5/12; B65D 5/18; B65D 5/20; B65D 5/2033; B65D 5/2047; B65D 5/2057; B65D 5/22; B65D 5/241; B65D 5/247; B65D 5/28; B65D 5/30; B65D 5/304; B65D 5/308; B65D 5/32; B65D 5/321; B65D 5/322; B65D 5/324; B65D 5/325; B65D 5/326; B65D 5/328; B65D 5/3621; B65D 5/3628; B65D 5/3664; B65D 5/38; B65D 5/40; B65D 5/42; B65D 5/4204; B65D 5/4208; B65D 5/4212; B65D 5/4216; B65D 5/4266; B65D 5/4275; B65D 5/4279; B65D 5/441; B65D 5/443; B65D 5/445; B65D 5/46032; B65D 5/4608; B65D 5/46104; B65D 5/46128; B65D 5/46136; B65D 5/48; B65D 5/48002; B65D 5/48014; B65D 5/48024; B65D 5/48026; B65D 5/4804; B65D 5/48046; B65D 5/48048; B65D 5/50; B65D 5/5002; B65D 5/5004; B65D 5/5007; B65D 5/5009; B65D 5/5014; B65D 5/5016; B65D 5/5019; B65D 5/5021; B65D 5/5023; B65D 5/5028; B65D 5/503; B65D 5/5033; B65D 5/5035; B65D 5/5038; B65D 5/5045; B65D 5/505; B65D 5/5052; B65D 5/5059; B65D 5/5061; B65D 5/5069; B65D 5/5071; B65D 5/5085; B65D 5/52; B65D 5/54; B65D 85/62; B65D 85/64; B65D 85/68; B65D 85/72; B65D 85/76; B65D 85/78; B65D 85/80; B65D 88/14; B65D 88/526; B65D 88/528; B65D 9/14; B65D 9/38; B65D 90/00; B65D 90/023; B65D 90/06; B65D 90/08; B65D 1/00; B65D 1/02; B65D 1/0207; B65D 1/023; B65D 1/095; B65D 1/12; B65D 1/16; B65D 1/20; B65D 1/225; B65D 1/24; B65D 1/243; B65D 1/246; B65D 1/265; B65D 1/28; B65D 1/32; B65D 1/42; B65D 1/48; B65D 11/00; B65D 11/04; B65D 11/105; B65D 11/18; B65D 11/1806; B65D 11/1826; B65D 11/184; B65D 11/1846; B65D 11/1853; B65D 11/186; B65D 11/1866; B65D 11/1873; B65D 11/1886; B65D 11/1893; B65D 11/20; B65D 15/00; B65D 15/02; B65D 15/06; B65D 15/16; B65D 15/24; B65D 17/28; B65D 17/36; B65D 17/401; B65D 17/4011; B65D 17/4012; B65D 17/4014; B65D 17/462; B65D 17/50; B65D 17/502; B65D 17/506; B65D 19/0002; B65D 19/0004; B65D 19/0012; B65D 19/0018; B65D 19/0022; B65D 19/0026; B65D 19/0038; B65D 19/004; B65D 19/0069; B65D 19/0073; B65D 19/0075; B65D 19/0091; B65D 19/0095; B65D 19/0097; B65D 19/02; B65D 19/10; B65D 19/16; B65D 19/385; B65D 19/42; B65D 21/0204; B65D 21/0206; B65D 21/0215; B65D 21/0216; B65D 21/0217; B65D 21/0219; B65D 21/022; B65D 21/0224; B65D 21/0227; B65D 21/0228; B65D 21/023; B65D 21/0231; B65D 21/0234; B65D 21/0237; B65D 21/04; B65D 21/045; B65D 21/062; B65D 21/064; B65D 21/068; B65D 21/086; B65D 2201/00; B65D 2203/02; B65D 2203/04; B65D 2203/08; B65D 2203/12; B65D 2207/00; B65D 2209/00; B65D 2211/00; B65D 2213/02; B65D 2215/02; B65D 2215/06; B65D 2215/08; B65D 2217/00; B65D 2221/00; B65D 2231/005; B65D 2231/022; B65D 2231/025; B65D 2231/027; B65D 2251/0021; B65D 2251/0028; B65D 2251/0071; B65D 2251/0081; B65D 2251/1008; B65D 2251/1016; B65D 2251/1033; B65D 2251/1041; B65D 2275/00; B65D 23/003; B65D 23/085; B65D 23/10; B65D 23/102; B65D 23/12; B65D 2301/00; B65D 2313/04; B65D 2313/06; B65D 2313/08; B65D 2401/10; B65D 2401/20; B65D 2401/55; B65D 2401/60; B65D 25/06; B65D 25/103; B65D 25/108; B65D 25/2841; B65D 25/2888; B65D 25/30; B65D 25/36; B65D 25/38; B65D 25/40; B65D 25/48; B65D 2501/24019; B65D 2501/2407; B65D 2501/24152; B65D 2501/24235; B65D 2501/24522; B65D 2517/0008; B65D 2517/0014; B65D 2517/0049; B65D 2517/0061; B65D 2517/0098; B65D 2519/00044; B65D 2519/00089; B65D 2519/00124; B65D 2519/00129; B65D 2519/00134; B65D 2519/00139; B65D 2519/00169; B65D 2519/00184; B65D 2519/00199; B65D 2519/00203; B65D 2519/00208; B65D 2519/00218; B65D 2519/00228; B65D 2519/00238; B65D 2519/00243; B65D 2519/00268; B65D 2519/00278; B65D 2519/00298; B65D 2519/00308; B65D 2519/00343; B65D 2519/00348; B65D 2519/00353; B65D 2519/00358; B65D 2519/00363; B65D 2519/00373; B65D 2519/00378; B65D 2519/00393; B65D 2519/00402; B65D 2519/00407; B65D 2519/00412; B65D 2519/00417; B65D 2519/00427; B65D 2519/00432; B65D 2519/00437; B65D 2519/00442; B65D 2519/00452; B65D 2519/00457; B65D 2519/00497; B65D 2519/00512; B65D 2519/00557; B65D 2519/00567; B65D 2519/00582; B65D 2519/00587; B65D 2519/00592; B65D 2519/00597; B65D 2519/00601; B65D 2519/00611; B65D 2519/00626; B65D 2519/00631; B65D 2519/00641; B65D 2519/00646; B65D 2519/00651; B65D 2519/00701; B65D 2519/00716; B65D 2519/00726;

B65D 2519/00751; B65D 2519/00756; B65D 2519/00771; B65D 2519/00786; B65D 2519/00796; B65D 2519/008; B65D 2519/0081; B65D 2519/00835; B65D 2519/0084; B65D 2519/0086; B65D 2519/0087; B65D 2519/0089; B65D 2519/00895; B65D 2519/0091; B65D 2519/00915; B65D 2519/0093; B65D 2519/0094; B65D 2519/0096; B65D 2519/00965; B65D 2519/0097; B65D 2519/00975; B65D 2519/0098; B65D 2519/00985; B65D 2519/0099; B65D 2525/283; B65D 2525/285; B65D 2525/288; B65D 2539/003; B65D 2539/006; B65D 2543/00037; B65D 2543/00083; B65D 2543/0012; B65D 2543/00138; B65D 2543/00212; B65D 2543/00231; B65D 2543/00333; B65D 2543/00361; B65D 2543/00407; B65D 2543/00425; B65D 2543/00435; B65D 2543/00444; B65D 2543/00453; B65D 2543/0062; B65D 2543/00629; B65D 2543/00648; B65D 2543/00657; B65D 2543/00666; B65D 2543/00694; B65D 2543/0074; B65D 2543/00759; B65D 2543/00768; B65D 2543/00796; B65D 2543/00833; B65D 2543/00842; B65D 2543/00944; B65D 2543/00953; B65D 2543/00962; B65D 2543/0099; B65D 2565/381; B65D 2565/382; B65D 2565/386; B65D 2571/00012; B65D 2571/00024; B65D 2571/0003; B65D 2571/00037; B65D 2571/00043; B65D 2571/00055; B65D 2571/00061; B65D 2571/00067; B65D 2571/00074; B65D 2571/00086; B65D 2571/00092; B65D 2571/00117; B65D 2571/00135; B65D 2571/00148; B65D 2571/00154; B65D 2571/0016; B65D 2571/00166; B65D 2571/00172; B65D 2571/00185; B65D 2571/00197; B65D 2571/00222; B65D 2571/0024; B65D 2571/00253; B65D 2571/00271; B65D 2571/00277; B65D 2571/00283; B65D 2571/0029; B65D 2571/00296; B65D 2571/00302; B65D 2571/00308; B65D 2571/00314; B65D 2571/0032; B65D 2571/00327; B65D 2571/0037; B65D 2571/00382; B65D 2571/00388; B65D 2571/00401; B65D 2571/00419; B65D 2571/00444; B65D 2571/0045; B65D 2571/00456; B65D 2571/00462; B65D 2571/00469; B65D 2571/00487; B65D 2571/00493; B65D 2571/00506; B65D 2571/00512; B65D 2571/00524; B65D 2571/0053; B65D 2571/00543; B65D 2571/00549; B65D 2571/00555; B65D 2571/0058; B65D 2571/00592; B65D 2571/00635; B65D 2571/00654; B65D 2571/00672; B65D 2571/00679; B65D 2571/00703; B65D 2571/00716; B65D 2571/00722; B65D 2571/00753; B65D 2571/00759; B65D 2571/00765; B65D 2571/00783; B65D 2571/0079; B65D 2571/00796; B65D 2571/00802; B65D 2571/00808; B65D 2571/00814; B65D 2571/0082; B65D 2571/00833; B65D 2571/00839; B65D 2571/00845; B65D 2571/00858; B65D 2571/00864; B65D 2571/0087; B65D 2571/00876; B65D 2571/00882; B65D 2571/00895; B65D 2571/00907; B65D 2571/00913; B65D 2571/00919; B65D 2571/00925; B65D 2571/00932; B65D 2571/00956; B65D 2571/00975; B65D 2571/00981; B65D 2571/00987; B65D 2571/00993; B65D 2575/3227; B65D 2575/3236; B65D 2575/329; B65D 2575/362; B65D 2575/363; B65D 2575/365; B65D 2575/366; B65D 2575/367; B65D 2575/368; B65D 2575/565; B65D 2575/58; B65D 2575/583; B65D 2575/586; B65D 2577/042; B65D 2577/043; B65D 2577/045; B65D 2577/047; B65D 2577/2025; B65D 2577/2066; B65D 2577/2075; B65D 2581/051; B65D 2581/056; B65D 2581/058; B65D 2581/3405; B65D 2581/3406; B65D 2581/3408; B65D 2581/3413; B65D 2581/3416; B65D 2581/3417; B65D 2581/3421; B65D 2581/3424; B65D 2581/3432; B65D 2581/3435; B65D 2581/3439; B65D 2581/344; B65D 2581/3441; B65D 2581/3443; B65D 2581/3447; B65D 2581/3454; B65D 2581/3455; B65D 2581/3456; B65D 2581/3458; B65D 2581/346; B65D 2581/3462; B65D 2581/3464; B65D 2581/3468; B65D 2581/3471; B65D 2581/3474; B65D 2581/3478; B65D 2581/3481; B65D 2581/3482; B65D 2581/3483; B65D 2581/3487; B65D 2581/3489; B65D 2581/3491; B65D 2581/3495; B65D 2581/3497; B65D 2581/3498; B65D 2583/0454; B65D 2583/0468; B65D 2583/0481; B65D 2585/30; B65D 2585/36; B65D 2585/363; B65D 2585/56; B65D 2585/647; B65D 2585/6812; B65D 2585/6815; B65D 2585/6817; B65D 2585/682; B65D 2585/6842; B65D 2585/6855; B65D 2585/6862; B65D 2585/6867; B65D 2585/6875; B65D 2585/6887; B65D 2585/689; B65D 2585/6892; B65D 2585/86; B65D 2585/88; B65D 2590/046; B65D 27/00; B65D 27/02; B65D 27/04; B65D 27/06; B65D 27/08; B65D 27/14; B65D 27/16; B65D 27/22; B65D 27/34; B65D 27/38; B65D 29/00; B65D 29/02; B65D 3/00; B65D 3/02; B65D 3/06; B65D 3/08; B65D 3/12; B65D 3/14; B65D 3/18; B65D 3/20; B65D 3/22; B65D 3/261; B65D 3/262; B65D 3/263; B65D 3/264; B65D 3/265; B65D 3/266; B65D 3/267; B65D 3/268; B65D 3/28; B65D 3/30; B65D 31/00; B65D 31/005; B65D 31/06; B65D 31/08; B65D 31/10; B65D 31/12; B65D 31/14; B65D 31/145; B65D 31/18; B65D 33/001; B65D 33/002; B65D 33/005; B65D 33/007;

B65D 33/008; B65D 33/04; B65D 33/06; B65D 33/065; B65D 33/08; B65D 33/10; B65D 33/105; B65D 33/12; B65D 33/16; B65D 33/165; B65D 33/1658; B65D 33/1675; B65D 33/1683; B65D 33/1691; B65D 33/18; B65D 33/20; B65D 33/243; B65D 33/25; B65D 33/2533; B65D 35/02; B65D 35/04; B65D 35/10; B65D 35/14; B65D 35/22; B65D 35/24; B65D 35/28; B65D 35/42; B65D 35/46; B65D 39/0023; B65D 39/02; B65D 39/04; B65D 39/08; B65D 41/00; B65D 41/02; B65D 41/04; B65D 41/0421; B65D 41/22; B65D 41/349; B65D 41/405; B65D 41/62; B65D 43/0204; B65D 43/021; B65D 43/0214; B65D 43/0216; B65D 43/0229; B65D 43/0281; B65D 43/14; B65D 43/16; B65D 43/161; B65D 43/165; B65D 43/169; B65D 43/20; B65D 43/22; B65D 45/00; B65D 45/28; B65D 45/32; B65D 47/00; B65D 47/043; B65D 47/061; B65D 47/066; B65D 47/0804; B65D 47/0842; B65D 47/103; B65D 47/106; B65D 47/123; B65D 47/14; B65D 47/20; B65D 47/2025; B65D 47/2081; B65D 47/263; B65D 47/32; B65D 47/36; B65D 47/38; B65D 49/06; B65D 49/12; B65D 5/0015; B65D 5/002; B65D 5/0025; B65D 5/0035; B65D 5/005; B65D 5/0055; B65D 5/006; B65D 5/0065; B65D 5/0075; B65D 5/0085; B65D 5/009; B65D 5/02; B65D 5/0218; B65D 5/0227; B65D 5/0245; B65D 5/0254; B65D 5/0263; B65D 5/0281; B65D 5/061; B65D 5/062; B65D 5/063; B65D 5/066; B65D 5/069; B65D 5/103; B65D 5/106; B65D 5/14; B65D 5/16; B65D 5/2004; B65D 5/2009; B65D 5/2019; B65D 5/2023; B65D 5/2028; B65D 5/2038; B65D 5/2042; B65D 5/2052; B65D 5/2066; B65D 5/2076; B65D 5/209; B65D 5/2095; B65D 5/24; B65D 5/242; B65D 5/243; B65D 5/244; B65D 5/245; B65D 5/246; B65D 5/248; B65D 5/26; B65D 5/301; B65D 5/302; B65D 5/307; B65D 5/323; B65D 5/327; B65D 5/36; B65D 5/3607; B65D 5/3614; B65D 5/3635; B65D 5/3642; B65D 5/3657; B65D 5/3678; B65D 5/3685; B65D 5/3692; B65D 5/422; B65D 5/4225; B65D 5/4229; B65D 5/4233; B65D 5/4237; B65D 5/4241; B65D 5/4245; B65D 5/425; B65D 5/4254; B65D 5/4258; B65D 5/427; B65D 5/4283; B65D 5/4287; B65D 5/4291; B65D 5/4295; B65D 5/44; B65D 5/446; B65D 5/448; B65D 5/46; B65D 5/46008; B65D 5/46016; B65D 5/46024; B65D 5/4604; B65D 5/46056; B65D 5/46072; B65D 5/46088; B65D 5/46096; B65D 5/46112; B65D 5/4612; B65D 5/46152; B65D 5/46192; B65D 5/48008; B65D 5/48016; B65D 5/48018; B65D 5/4802; B65D 5/48022; B65D 5/48028; B65D 5/4803; B65D 5/48032; B65D 5/48034; B65D 5/48036; B65D 5/48038; B65D 5/48042; B65D 5/48044; B65D 5/5011; B65D 5/5026; B65D 5/504; B65D 5/5042; B65D 5/5054; B65D 5/5057; B65D 5/5064; B65D 5/5066; B65D 5/5073; B65D 5/5076; B65D 5/5088; B65D 5/509; B65D 5/5206; B65D 5/5213; B65D 5/522; B65D 5/5226; B65D 5/5233; B65D 5/524; B65D 5/5246; B65D 5/5253; B65D 5/526; B65D 5/5266; B65D 5/5273; B65D 5/528; B65D 5/5286; B65D 5/5293; B65D 5/5405; B65D 5/541; B65D 5/5415; B65D 5/542; B65D 5/5425; B65D 5/543; B65D 5/5435; B65D 5/544; B65D 5/5445; B65D 5/545; B65D 5/5455; B65D 5/546; B65D 5/5475; B65D 5/548; B65D 5/5485; B65D 5/549; B65D 5/5495; B65D 5/56; B65D 5/563; B65D 5/566; B65D 5/58; B65D 5/60; B65D 5/603; B65D 5/606; B65D 5/62; B65D 5/64; B65D 5/643; B65D 5/66; B65D 5/6602; B65D 5/6605; B65D 5/6608; B65D 5/6611; B65D 5/6614; B65D 5/6617; B65D 5/662; B65D 5/6626; B65D 5/6629; B65D 5/6632; B65D 5/6635; B65D 5/6638; B65D 5/6644; B65D 5/6647; B65D 5/665; B65D 5/6652; B65D 5/6655; B65D 5/6658; B65D 5/6661; B65D 5/6664; B65D 5/6667; B65D 5/667; B65D 5/6673; B65D 5/6676; B65D 5/6679; B65D 5/6685; B65D 5/6688; B65D 5/6691; B65D 5/6694; B65D 5/6697; B65D 5/68; B65D 5/685; B65D 5/70; B65D 5/701; B65D 5/703; B65D 5/705; B65D 5/706; B65D 5/708; B65D 5/72; B65D 5/721; B65D 5/722; B65D 5/723; B65D 5/724; B65D 5/725; B65D 5/726; B65D 5/727; B65D 5/728; B65D 5/74; B65D 5/741; B65D 5/742; B65D 5/743; B65D 5/744; B65D 5/745; B65D 5/746; B65D 5/747; B65D 5/748; B65D 5/749; B65D 5/76; B65D 50/00; B65D 50/02; B65D 50/043; B65D 50/045; B65D 50/046; B65D 50/06; B65D 51/00; B65D 51/002; B65D 51/14; B65D 51/1611; B65D 51/1616; B65D 51/1644; B65D 51/18; B65D 51/185; B65D 51/20; B65D 51/22; B65D 51/224; B65D 51/225; B65D 51/227; B65D 51/228; B65D 51/24; B65D 51/242; B65D 51/244; B65D 51/245; B65D 51/246; B65D 51/247; B65D 51/248; B65D 51/26; B65D 51/28; B65D 51/2814; B65D 51/2821; B65D 51/2835; B65D 51/2864; B65D 51/30; B65D 53/00; B65D 53/02; B65D 53/04; B65D 53/06; B65D 53/08; B65D 55/00; B65D 55/02; B65D 55/024; B65D 55/026; B65D 55/028; B65D 55/04; B65D 55/06; B65D 55/08; B65D 55/0818; B65D 55/0854; B65D 55/089; B65D 55/16; B65D 57/00; B65D 57/002; B65D 57/003; B65D 57/004; B65D 57/005; B65D 59/00; B65D 59/02; B65D

59/04; B65D 59/06; B65D 59/08; B65D 61/00; B65D 63/02; B65D 63/10; B65D 63/1009; B65D 63/1027; B65D 63/109; B65D 63/16; B65D 63/18; B65D 65/00; B65D 65/02; B65D 65/04; B65D 65/06; B65D 65/10; B65D 65/12; B65D 65/14; B65D 65/18; B65D 65/22; B65D 65/24; B65D 65/38; B65D 65/40; B65D 65/403; B65D 65/406; B65D 65/42; B65D 65/44; B65D 65/46; B65D 65/463; B65D 65/466; B65D 67/00; B65D 67/02; B65D 69/00; B65D 7/00; B65D 7/02; B65D 7/06; B65D 7/08; B65D 7/10; B65D 7/12; B65D 7/24; B65D 7/26; B65D 7/28; B65D 7/38; B65D 71/00; B65D 71/0003; B65D 71/0014; B65D 71/0022; B65D 71/0029; B65D 71/004; B65D 71/0048; B65D 71/007; B65D 71/0077; B65D 71/0085; B65D 71/0088; B65D 71/0092; B65D 71/0096; B65D 71/02; B65D 71/04; B65D 71/06; B65D 71/063; B65D 71/066; B65D 71/08; B65D 71/10; B65D 71/12; B65D 71/125; B65D 71/14; B65D 71/16; B65D 71/18; B65D 71/20; B65D 71/22; B65D 71/24; B65D 71/243; B65D 71/246; B65D 71/26; B65D 71/30; B65D 71/32; B65D 71/34; B65D 71/36; B65D 71/38; B65D 71/40; B65D 71/403; B65D 71/42; B65D 71/44; B65D 71/46; B65D 71/48; B65D 71/50; B65D 71/504; B65D 71/508; B65D 71/70; B65D 71/72; B65D 73/00; B65D 73/0007; B65D 73/0014; B65D 73/0021; B65D 73/0028; B65D 73/0035; B65D 73/0042; B65D 73/005; B65D 73/0057; B65D 73/0064; B65D 73/0071; B65D 73/0078; B65D 73/0085; B65D 73/0092; B65D 73/02; B65D 75/00; B65D 75/002; B65D 75/004; B65D 75/006; B65D 75/008; B65D 75/02; B65D 75/04; B65D 75/06; B65D 75/08; B65D 75/12; B65D 75/14; B65D 75/18; B65D 75/20; B65D 75/22; B65D 75/225; B65D 75/24; B65D 75/245; B65D 75/26; B65D 75/28; B65D 75/30; B65D 75/305; B65D 75/32; B65D 75/322; B65D 75/323; B65D 75/324; B65D 75/325; B65D 75/326; B65D 75/327; B65D 75/328; B65D 75/34; B65D 75/36; B65D 75/366; B65D 75/367; B65D 75/368; B65D 75/38; B65D 75/40; B65D 75/42; B65D 75/44; B65D 75/46; B65D 75/48; B65D 75/50; B65D 75/52; B65D 75/522; B65D 75/525; B65D 75/527; B65D 75/54; B65D 75/545; B65D 75/56; B65D 75/563; B65D 75/566; B65D 75/58; B65D 75/5805; B65D 75/5811; B65D 75/5816; B65D 75/5822; B65D 75/5827; B65D 75/5833; B65D 75/5838; B65D 75/5844; B65D 75/585; B65D 75/5855; B65D 75/5861; B65D 75/5866; B65D 75/5872; B65D 75/5877; B65D 75/5883; B65D 75/5888; B65D 75/5894; B65D 75/66; B65D 75/68; B65D 75/70; B65D 77/00; B65D 77/003; B65D 77/006; B65D 77/02; B65D 77/04; B65D 77/0406; B65D 77/0413; B65D 77/042; B65D 77/0426; B65D 77/0433; B65D 77/0446; B65D 77/0453; B65D 77/046; B65D 77/0466; B65D 77/0486; B65D 77/0493; B65D 77/06; B65D 77/061; B65D 77/062; B65D 77/064; B65D 77/065; B65D 77/067; B65D 77/068; B65D 77/08; B65D 77/10; B65D 77/12; B65D 77/14; B65D 77/20; B65D 77/2004; B65D 77/2008; B65D 77/2016; B65D 77/2024; B65D 77/2028; B65D 77/2032; B65D 77/2036; B65D 77/204; B65D 77/2044; B65D 77/2052; B65D 77/2056; B65D 77/206; B65D 77/2064; B65D 77/208; B65D 77/2088; B65D 77/2092; B65D 77/2096; B65D 77/22; B65D 77/225; B65D 77/24; B65D 77/245; B65D 77/26; B65D 77/28; B65D 77/30; B65D 77/32; B65D 77/38; B65D 79/00; B65D 79/0084; B65D 79/0087; B65D 79/02; B65D 81/00; B65D 81/02; B65D 81/022; B65D 81/025; B65D 81/027; B65D 81/03; B65D 81/05; B65D 81/051; B65D 81/052; B65D 81/053; B65D 81/054; B65D 81/055; B65D 81/056; B65D 81/057; B65D 81/058; B65D 81/07; B65D 81/075; B65D 81/09; B65D 81/107; B65D 81/1075; B65D 81/113; B65D 81/127; B65D 81/1275; B65D 81/133; B65D 81/18; B65D 81/20; B65D 81/2007; B65D 81/2015; B65D 81/2023; B65D 81/203; B65D 81/2038; B65D 81/2053; B65D 81/2061; B65D 81/2069; B65D 81/2076; B65D 81/2084; B65D 81/22; B65D 81/24; B65D 81/245; B65D 81/26; B65D 81/261; B65D 81/262; B65D 81/263; B65D 81/264; B65D 81/265; B65D 81/266; B65D 81/267; B65D 81/268; B65D 81/28; B65D 81/30; B65D 81/32; B65D 81/3205; B65D 81/3211; B65D 81/3216; B65D 81/3222; B65D 81/3227; B65D 81/3233; B65D 81/3261; B65D 81/3266; B65D 81/3272; B65D 81/3283; B65D 81/3288; B65D 81/3294; B65D 81/34; B65D 81/3415; B65D 81/343; B65D 81/3438; B65D 81/3446; B65D 81/3453; B65D 81/3461; B65D 81/3469; B65D 81/3484; B65D 81/36; B65D 81/361; B65D 81/365; B65D 81/368; B65D 81/38; B65D 81/3813; B65D 81/3816; B65D 81/3818; B65D 81/382; B65D 81/3823; B65D 81/3825; B65D 81/3827; B65D 81/3834; B65D 81/3848; B65D 81/3851; B65D 81/3853; B65D 81/3858; B65D 81/386; B65D 81/3862; B65D 81/3869; B65D 81/3872; B65D 81/3874; B65D 81/3876; B65D 81/3886; B65D 81/3888; B65D 81/389; B65D 81/3893; B65D 81/3895; B65D 81/3897; B65D 83/00; B65D 83/0005; B65D 83/0011; B65D 83/0033; B65D 83/0038; B65D 83/005; B65D 83/0055; B65D 83/0061; B65D 83/0072; B65D 83/0083; B65D

83/0088; B65D 83/0094; B65D 83/02; B65D 83/04; B65D 83/0409; B65D 83/0445; B65D 83/0463; B65D 83/0481; B65D 83/06; B65D 83/08; B65D 83/0805; B65D 83/0811; B65D 83/0817; B65D 83/0823; B65D 83/0835; B65D 83/0841; B65D 83/0847; B65D 83/0852; B65D 83/0858; B65D 83/0876; B65D 83/0882; B65D 83/0888; B65D 83/0894; B65D 83/10; B65D 83/14; B65D 83/205; B65D 83/285; B65D 83/30; B65D 83/303; B65D 83/38; B65D 83/384; B65D 83/62; B65D 85/00; B65D 85/02; B65D 85/04; B65D 85/07; B65D 85/08; B65D 85/10; B65D 85/1009; B65D 85/1018; B65D 85/1027; B65D 85/1036; B65D 85/1045; B65D 85/1048; B65D 85/10484; B65D 85/1054; B65D 85/1056; B65D 85/10564; B65D 85/10566; B65D 85/10568; B65D 85/1063; B65D 85/1072; B65D 85/1081; B65D 85/109; B65D 85/12; B65D 85/18; B65D 85/182; B65D 85/185; B65D 85/187; B65D 85/20; B65D 85/24; B65D 85/30; B65D 85/305; B65D 85/307; B65D 85/32; B65D 85/322; B65D 85/324; B65D 85/325; B65D 85/327; B65D 85/328; B65D 85/34; B65D 85/345; B65D 85/36; B65D 85/38; B65D 85/40; B65D 85/42; B65D 85/44; B65D 85/46; B65D 85/48; B65D 85/50; B65D 85/505; B65D 85/52; B65D 85/54; B65D 85/542; B65D 85/544; B65D 85/546; B65D 85/548; B65D 85/58; B65D 85/60; B65D 85/66; B65D 85/67; B65D 85/671; B65D 85/672; B65D 85/676; B65D 85/70; B65D 85/74; B65D 85/804; B65D 85/8043; B65D 85/8046; B65D 85/8055; B65D 85/8058; B65D 85/8061; B65D 85/8064; B65D 85/808; B65D 85/8085; B65D 85/812; B65D 85/816; B65D 88/022; B65D 88/12; B65D 88/121; B65D 88/1625; B65D 88/1631; B65D 88/1668; B65D 88/1675; B65D 88/542; B65D 88/72; B65D 9/06; B65D 9/08; B65D 9/12; B65D 9/30; B65D 9/32; B65D 9/34; B65D 90/0033; B65D 90/046; B65D 90/205; B65D 90/626; B65D 15/04; B65D 15/20; B65D 17/08; B65D 17/353; B65D 17/402; B65D 17/404; B65D 19/0006; B65D 19/0053; B65D 19/08; B65D 21/0226; B65D 2205/025; B65D 2251/0031; B65D 2251/1025; B65D 2251/1058; B65D 23/02; B65D 2401/45; B65D 2401/50; B65D 25/00; B65D 25/005; B65D 25/105; B65D 25/106; B65D 25/18; B65D 25/28; B65D 25/2802; B65D 25/2805; B65D 25/2808; B65D 25/287; B65D 25/2873; B65D 25/2876; B65D 25/42; B65D 25/46; B65D 25/465; B65D 25/56; B65D 2501/0081; B65D 2501/24108; B65D 2501/24324; B65D 2501/2435; B65D 2517/0013; B65D 2517/005; B65D 2517/0056; B65D 2519/00079; B65D 2519/00547; B65D 2519/00616; B65D 2519/00636; B65D 2519/00676; B65D 2519/00761; B65D 2519/00766; B65D 2519/00781; B65D 2519/00945; B65D 2543/00148; B65D 2543/00166; B65D 2543/00203; B65D 2543/00388; B65D 2543/00675; B65D 2543/00981; B65D 2571/00049; B65D 2571/00098; B65D 2571/00123; B65D 2571/00351; B65D 2571/00376; B65D 2571/00407; B65D 2571/00438; B65D 2581/02; B65D 2581/05; B65D 2581/052; B65D 2581/057; B65D 2581/3412; B65D 2581/3429; B65D 2581/3444; B65D 2581/3448; B65D 2581/347; B65D 2581/3493; B65D 2585/64; B65D 2585/642; B65D 2585/644; B65D 2585/645; B65D 2585/6802; B65D 2585/6805; B65D 2585/6807; B65D 2585/681; B65D 2585/6825; B65D 2585/6827; B65D 2585/6845; B65D 2585/6847; B65D 2585/6857; B65D 2585/6872; B65D 2585/6877; B65D 2585/6895; B65D 2588/165; B65D 2590/005; B65D 27/005; B65D 33/1616; B65D 35/12; B65D 35/38; B65D 35/44; B65D 39/084; B65D 41/083; B65D 43/0206; B65D 43/0237; B65D 43/0254; B65D 43/0258; B65D 43/24; B65D 45/02; B65D 47/10; B65D 5/007; B65D 5/0095; B65D 5/0272; B65D 5/5047; B65D 5/5092; B65D 5/5095; B65D 5/5097; B65D 5/547; B65D 50/04; B65D 51/1605; B65D 55/10; B65D 55/12; B65D 55/14; B65D 57/006; B65D 63/00; B65D 65/08; B65D 7/04; B65D 7/065; B65D 7/14; B65D 7/22; B65D 7/30; B65D 7/44; B65D 7/48; B65D 71/0007; B65D 77/2048; B65D 77/2068; B65D 77/2076; B65D 79/005; B65D 79/008; B65D 81/2092; B65D 83/76; B65D 83/771; B65D 85/06; B65D 85/302; B65D 85/321; B65D 85/677; B65D 88/005; B65D 88/1618; B65D 88/1681; B65D 88/52; B65D 88/741; B65D 88/744; B65D 9/10; B65D 9/24; B65D 90/0026; B65D 90/0053; B65D 90/02; B65D 90/52; B65G 90/08; B65G 1/00; B65G 1/04; B65G 1/045; B65G 1/06; B65G 1/12; B65G 1/127; B65G 1/1371; B65G 1/1373; B65G 1/1376; B65G 17/002; B65G 21/2054; B65G 2201/0202; B65G 2201/0211; B65G 2201/0244; B65G 2201/0258; B65G 2201/0261; B65G 2203/041; B65G 2207/14; B65G 2207/46; B65G 2249/02; B65G 23/04; B65G 23/44; B65G 35/00; B65G 37/00; B65G 47/082; B65G 47/252; B65G 47/5104; B65G 47/5113; B65G 47/91; B65G 49/062; B65G 49/068; B65G 51/03; B65G 57/24; B65G 65/00; B65G 65/365; B65G 65/425; B65G 67/04; B65G 67/20; B65G 69/00; B65H 18/28; B65H 20/08; B65H 20/32; B65H 23/063; B65H 2301/4491; B65H 2404/22; B65H

2404/242; B65H 2406/321; B65H 2511/14; B65H 2515/31; B65H 2515/37; B65H 2701/17; B65H 2701/176; B65H 2701/1944; B65H 2701/314; B65H 2701/34; B65H 2701/377; B65H 2701/38; B65H 2801/51; B65H 2801/57; B65H 29/60; B65H 29/62; B65H 3/08; B65H 3/12; B65H 3/126; B65H 3/48; B65H 3/54; B65H 35/002; B65H 35/0026; B65H 35/0033; B65H 35/008; B65H 35/0086; B65H 35/0093; B65H 35/06; B65H 37/002; B65H 37/005; B65H 37/04; B65H 37/06; B65H 43/00; B65H 45/14; B65H 5/021; B65H 59/10; B65H 75/362

USPC ..... 53/122, 128.1, 131.3, 133.2, 157, 171, 53/244, 248, 258, 260, 261, 281, 287, 53/290, 410, 415, 419, 428, 432, 436, 53/440, 442, 443, 445, 447, 448, 449, 53/452, 456, 471, 472, 473, 474, 477, 53/497, 537, 539, 540, 541, 542, 564; 206/0.5, 0.6, 0.7, 0.82, 1.5, 1.7, 1.9, 139, 206/14, 140, 141, 144, 145, 148, 15, 206/15.3, 150, 151, 152, 155, 158, 161, 206/162, 170, 18, 187, 192, 193, 194, 206/196, 197, 198, 202, 203, 204, 205, 206/209, 210, 213.1, 214, 215, 216, 217, 206/219, 220, 221, 222, 223, 225, 226, 206/227, 229, 231, 232, 233, 242, 245, 206/247, 254, 256, 260, 261, 264, 265, 206/268, 273, 274, 277, 278, 279, 292, 206/297, 299, 3, 301, 303, 304, 305, 306, 206/307, 307.1, 308.1, 308.2, 308.3, 309, 206/310, 311, 312, 313, 314, 315.1, 206/315.11, 315.9, 316.1, 316.2, 317, 206/319, 320, 321, 322, 325, 326, 327, 206/335, 338, 339, 340, 343, 345, 349, 206/352, 354, 356, 361, 362, 362.2, 206/362.4, 363, 364, 365, 366, 367, 368, 206/369, 37, 370, 371, 372, 373, 379, 38, 206/380, 382, 384, 386, 387.1, 387.11, 206/387.13, 388, 389, 390, 391, 392, 394, 206/395, 396, 397, 407, 408, 409, 410, 206/412, 413, 416, 418, 419, 420, 421, 206/422, 423, 424, 425, 426, 427, 428, 206/429, 430, 431, 432, 433, 434, 436, 206/438, 439, 440, 441, 443, 445, 446, 206/447, 448, 449, 45.2, 45.23, 45.24, 206/45.27, 45.29, 45.3, 451, 452, 453, 206/454, 455, 456, 457, 459.1, 459.5, 206/460, 461, 462, 463, 464, 466, 467, 206/468, 469, 470, 471, 472, 473, 474, 206/476, 477, 478, 479, 480, 482, 483, 206/484, 484.1, 484.2, 485, 486, 488, 206/489, 49, 490, 493, 494, 495, 497, 206/499, 5, 5.1, 500, 501, 502, 503, 504, 206/505, 506, 507, 508, 509, 510, 511, 206/512, 513, 515, 516, 518, 519, 520, 206/521, 521.1, 521.15, 521.2, 521.3, 206/521.4, 521.5, 521.6, 521.7, 521.8, 206/521.9, 522, 523, 524, 524.1, 524.2, 206/524.3, 524.4, 524.5, 524.6, 524.7, 206/524.8, 524.9, 525, 526, 527, 528, 206/530, 531, 532, 533, 534, 534.1, 535, 206/536, 538, 539, 540, 541, 542, 544, 206/545, 548, 549, 551, 554, 555, 557, 206/558, 560, 561, 562, 563, 564, 565, 206/568, 569, 570, 571, 572, 575, 576, 206/577, 579, 581, 583, 584, 585, 586, 206/587, 588, 589, 590, 591, 592, 593, 206/594, 596, 597, 599, 6, 6.1, 600, 63.3, 206/63.5, 68, 69, 701, 702, 703, 706, 206/707, 709, 710, 711, 713, 714, 716, 206/718, 719, 720, 721, 722, 723, 724, 206/725, 726, 728, 736, 738, 739, 743, 206/745, 746, 750, 751, 752, 754, 755, 206/756, 759, 762, 763, 764, 767, 768, 206/769, 770, 772, 774, 775, 776, 777, 206/778, 779, 780, 781, 782, 783, 784, 8, 206/802, 803, 804, 805, 806, 807, 811, 206/812, 813, 814, 815, 818, 819, 820, 206/821, 822, 823, 824, 828, 83, 83.5, 206/830, 831, 832, 0.8, 0.81, 0.815, 0.83, 206/0.84, 1.8, 100, 102, 103, 104, 107, 206/109, 110, 112, 114, 115, 116, 124, 206/137, 142, 143, 147, 149, 15.2, 153, 206/154, 156, 157, 159, 160, 163, 164, 206/165, 166, 167, 168, 169, 171, 172, 206/173, 174, 175, 176, 177, 179, 180, 206/181, 182, 183, 184, 186, 188, 189, 206/19, 190, 191, 195, 199, 200, 201, 206/206; 206/207, 208, 212, 213, 218, 206/230, 234, 235, 236, 237, 239, 244, 206/246, 248, 249, 250, 251, 252, 254, 206/255, 258, 259, 266, 267, 269, 270, 206/271, 275, 276, 278, 278.1, 280, 281, 206/284, 285, 286, 287, 287.1, 288, 289, 206/290, 291, 293, 294, 295, 296, 298, 206/300, 304.1, 304.2, 308, 315.2, 315.3, 206/315.6, 315.7, 315.8, 318, 323, 324, 206/337, 341, 342, 346, 347, 348, 350, 206/351, 353, 355, 357, 358, 359, 362.1, 206/362.3, 37.1, 376, 378, 38.1, 381, 383, 206/385, 387.12, 387.14, 387.15, 39, 393, 206/398, 399, 400, 401, 402, 403, 404, 206/406, 411, 414, 415, 417, 435, 442, 206/45.21, 45.22, 45.25, 450, 458, 465, 206/475, 481, 485.1, 487, 496, 514, 517, 206/525.1, 529, 53, 534.2, 537, 546, 550, 206/553, 556, 559, 566, 573, 574, 578, 206/580, 582, 595, 598, 704, 705, 708, 206/712, 715, 717, 727, 730, 731, 732, 206/733, 734, 735, 740, 741, 742, 744, 206/747, 748, 749, 757, 758, 760, 761, 206/765, 766, 77.1, 771, 773, 800, 809, 206/81, 810, 816, 817, 825, 829, 85, 87, 206/89, 9, 91, 92, 93, 94, 95, 96, 98; 220/23.6, 23.89, 374, 4.24, 505, 521, 522, 220/62.1, 669, 673, 675, 88.2, 902, 1.5, 220/200, 213, 23.4, 23.8, 23.83, 23.86, 220/23.87, 23.88, 23.9, 231, 238, 240, 220/220, 252, 254.1, 256.1, 258.2, 266, 220/270, 287, 297, 298, 3.2, 3.3, 3.4, 3.5, 220/3.6, 3.9, 3.94, 315, 324, 325, 326, 220/359.1, 359.3, 367.1, 375, 377, 380, 220/4.01, 4.03, 4.04, 4.05, 4.09, 4.21, 220/4.22, 4.23, 4.27, 4.28, 4.29, 4.31, 220/4.33, 481, 482, 485, 489, 494, 220/495.03, 495.06, 495.07, 495.11, 500, 220/507, 510, 516, 527, 528, 529, 532,

220/533, 543, 552, 555, 560, 560.01, 220/560.03, 560.15, 563, 565, 573, 573.1, 220/574, 582, 592, 592.01, 592.05, 220/592.09, 592.1, 592.14, 592.16, 220/592.17, 592.2, 592.21, 592.22, 220/592.23, 592.25, 592.26, 592.27, 6, 220/600, 602, 604, 608, 609, 610, 612, 220/613, 615, 617, 62, 62.11, 62.12, 220/62.19, 62.2, 62.22, 622, 623, 625, 220/626, 628, 632, 635, 639, 641, 642, 220/646, 647, 649, 651, 659, 660, 662, 220/665, 666, 668, 671, 672, 676, 678, 220/682, 683, 684, 689, 691, 694, 698, 7, 220/701, 710, 713, 719, 720, 723, 735, 220/737, 738, 739, 745, 757, 760, 761, 220/771, 772, 780, 782, 784, 798, 799, 8, 220/801, 812, 817, 826, 833, 835, 837, 220/839, 845, 9.2, 9.4, 900, 908, 908.1, 220/913, 915.1, 920, DIG. 15, DIG. 24, 220/DIG. 30, DIG. 5, 236; 224/148.2, 224/148.7, 220, 586, 602, 604, 674, 931; 229/103.2, 110, 112, 115, 116, 117.09, 229/117.14, 120, 120.11, 120.12, 120.14, 229/120.15, 120.18, 120.22, 120.24, 229/120.32, 120.34, 122, 122.1, 125.01, 229/125.015, 125.08, 137, 143, 148, 149, 229/153, 162.1, 164.2, 165, 178, 185.1, 229/195, 216, 219, 221, 235, 237, 242, 229/4.5, 406, 5.5, 5.84, 87.08, 91, 919, 229/939, 100, 101, 101.1, 101.2, 102, 229/102.5, 103, 103.1, 103.11, 103.3, 229/104, 105, 106, 107, 108, 108.1, 109, 229/113, 114, 116.1, 116.2, 116.3, 116.4, 229/116.5, 117, 117.01, 117.02, 117.03, 229/117.04, 117.05, 117.06, 117.07, 229/117.08, 117.11, 117.12, 117.13, 229/117.15, 117.16, 117.17, 117.18, 229/117.19, 117.21, 117.22, 117.23, 229/117.24, 117.25, 117.26, 117.27, 229/117.28, 117.3, 117.32, 117.33, 229/117.34, 117.35, 119, 120.01, 229/120.011, 120.012, 120.02, 120.03, 229/120.04, 120.05, 120.06, 120.07, 229/120.08, 120.09, 120.1, 120.13, 229/120.16, 120.17, 120.21, 120.23, 229/120.25, 120.26, 120.27, 120.28, 229/120.29, 120.31, 120.33, 120.35, 229/120.36, 120.37, 120.38, 121, 122.2, 229/122.21, 122.22, 122.23, 122.24, 229/122.25, 122.26, 122.27, 122.28, 229/122.29, 122.3, 122.31, 122.32, 229/122.33, 122.34, 123, 123.1, 123.2, 229/123.3, 124, 125, 125.02, 125.03, 229/125.04, 125.05, 125.06, 125.07, 229/125.09, 125.11, 125.12, 125.125, 229/125.13, 125.14, 125.17, 125.18, 229/125.19, 125.21, 125.22, 125.23, 229/125.26, 125.27, 125.28, 125.29, 229/125.31, 125.32, 125.33, 125.34, 229/125.35, 125.36, 125.37, 125.38, 229/125.39, 125.41, 125.42, 126, 127, 229/128,129, 129.1, 130, 131, 131.1, 132, 229/134, 135, 136, 138, 139, 140, 141, 229/142, 144, 145, 146, 147, 150, 151, 229/152, 154, 155, 156, 157, 158, 159, 229/160, 160.1, 160.2, 161, 162.2, 162.3, 229/162.4, 162.5, 162.6, 162.7, 163, 164, 229/164.1, 166, 167, 168, 169, 170, 171, 229/172, 173, 174, 175, 176, 177, 179, 229/180, 181, 182, 182.1, 183, 184, 185, 229/186, 187, 188, 189, 190, 191, 192, 229/193, 194, 196, 197, 198, 198.1, 229/198.2, 198.3, 199, 199.1, 200, 202, 229/203, 204, 207, 208, 209, 210, 212, 229/213, 214, 215, 217, 218, 220, 222, 229/223, 224, 225, 226, 227, 228, 229, 229/230, 231, 232, 233, 234, 236, 238, 229/239, 240, 241, 243, 244, 245, 246, 229/247, 248, 249, 303, 309, 313, 314, 229/400, 401, 402, 403, 404, 405, 407, 229/5.6, 5.7, 5.8, 5.81, 5.82, 5.83, 5.85, 229/67.1, 67.2, 67.3, 67.4, 68.1, 69, 70, 229/71, 72, 74, 75, 76, 80, 800, 84, 229/87.01, 87.02, 87.03, 87.04, 87.05, 229/87.06, 87.07, 87.09, 87.11, 87.13, 229/87.15, 87.17, 87.18, 87.19, 87.2, 229/87.5, 89, 90, 900, 901, 902, 903, 229/904, 904.1, 905, 906, 906.1, 907, 229/909, 910, 911, 913, 914, 915, 915.1, 229/916, 917, 918, 92, 92.8, 920, 921, 229/922, 923, 924; 229/925, 927, 93, 229/930, 931, 932, 933, 935, 936, 937, 229/938, 939, 940, 941, 942, FOR. 100, 229/FOR. 105, FOR. 108

See application file for complete search history.

(56) References Cited

U.S. PATENT DOCUMENTS

| | | | | | |
|---|---|---|---|---|---|
| 3,211,283 | A * | 10/1965 | Hassler | B65D 25/102 | 206/424 |
| 4,865,200 | A * | 9/1989 | Sullivan | B65D 5/5035 | 206/451 |
| 4,974,770 | A * | 12/1990 | Wright | B65D 75/14 | 206/455 |
| 5,156,331 | A * | 10/1992 | Pirre | B65D 83/08 | 206/455 |
| 5,934,549 | A * | 8/1999 | Baumgartner | B65D 5/422 | 229/92.8 |
| 8,365,914 | B2 | 2/2013 | Learn | | |
| 9,902,550 | B2 | 2/2018 | Roozrokh | | |
| 10,239,653 | B2 | 3/2019 | Putko | | |
| 10,786,002 | B2 | 9/2020 | McKinney | | |
| 11,352,164 | B2 | 6/2022 | Barbieri et al. | | |
| 11,440,282 | B2 | 9/2022 | Wiley | | |
| 2004/0074798 | A1* | 4/2004 | Taylor | B65D 77/042 | 206/583 |
| 2013/0140303 | A1* | 6/2013 | James | B65D 5/5035 | 206/521 |
| 2017/0197750 | A1* | 7/2017 | Wolf | B65D 5/66 | |

FOREIGN PATENT DOCUMENTS

| | | | | |
|---|---|---|---|---|
| JP | H01103565 | * | 7/1987 | B65D 65/06 |
| JP | 2004352269 | * | 12/2004 | B65D 81/113 |
| JP | 2004352269 A | * | 12/2004 | B65D 81/113 |
| JP | 2019189303 | * | 10/2019 | B65D 5/44 |
| JP | 2019189303 A | * | 10/2019 | Y02W 30/80 |
| PL | 237431 B1 | * | 4/2021 | B65D 5/54 |
| WO | WO2003022693 A1 | * | 3/2003 | B65D 5/52 |
| WO | WO-2015140469 A1 | * | 9/2015 | B65D 5/443 |

(56) References Cited

OTHER PUBLICATIONS

"Understanding Consumers Emotional Response to Protective Materials in Parcel Packaging" (Package Insight, 2016), at https://packageinsight.com/wp-content/uploads/2020/02/Pre.

* cited by examiner

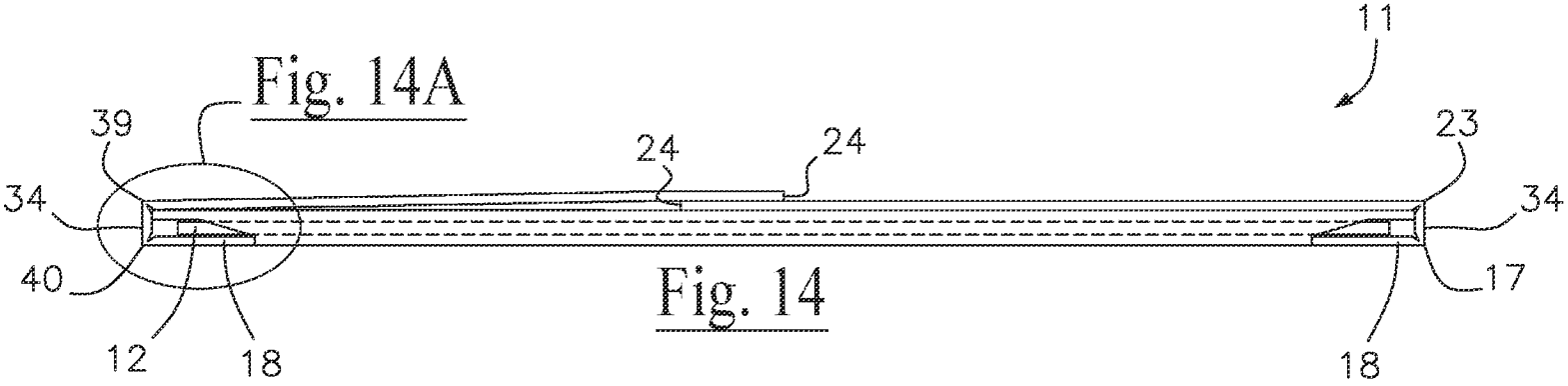
Fig. 14
Fig. 14A
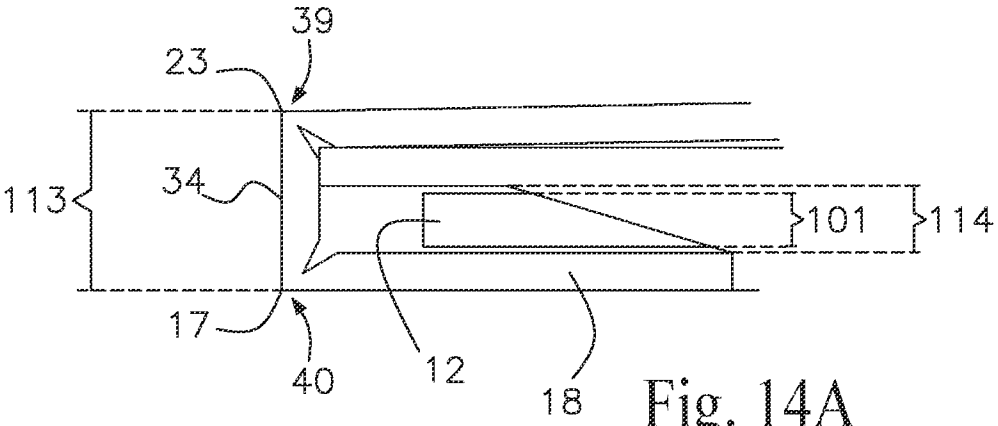
Fig. 14A

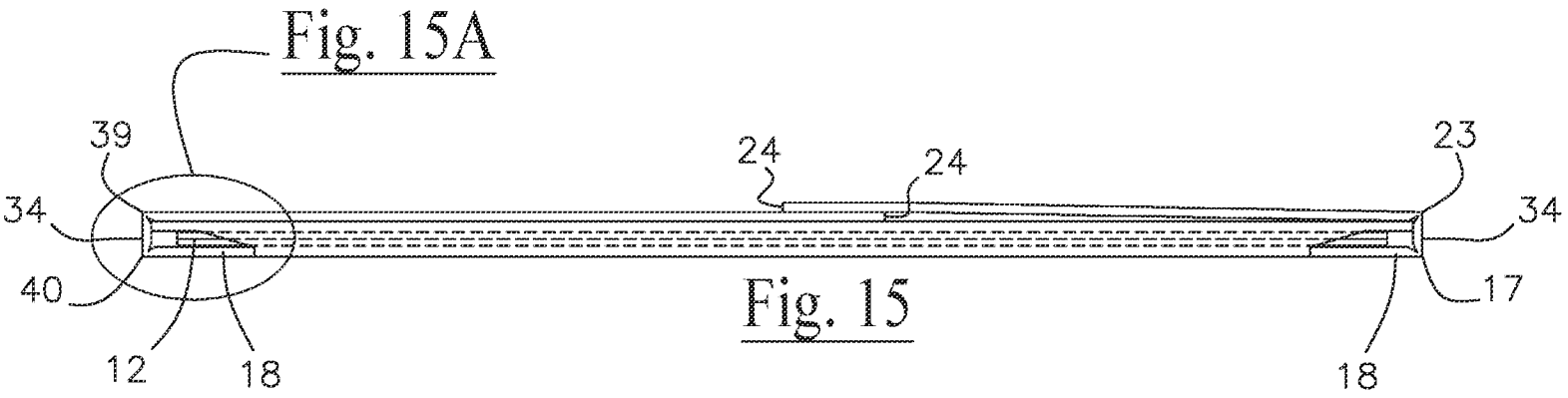
Fig. 15
Fig. 15A
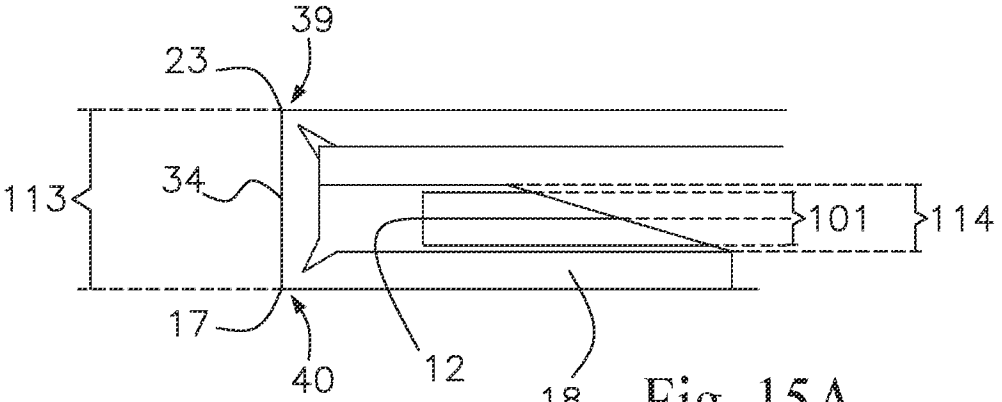
Fig. 15A

DAMAGE-RESISTANT PACKAGING BOX FOR SHIPPING PLANAR ARTICLES

PRIOR HISTORY

This patent application is a Continuation-in-Part patent application claiming the benefit of U.S. Design patent application No. 29/862,224 filed in the United States Patent and Trademark Office on 7 Dec. 2022, the specifications and drawings of which are hereby incorporated by reference.

BACKGROUND OF THE INVENTION

Field of the Invention

The present invention generally relates to a packaging box for shipping articles through various package delivery systems. More particularly, the present invention relates to a packaging box particularly configured to provide box-strengthening corners that function to resist damage from impacts to the packaging box and the substantially planar articles shipped thereby.

Brief Description of the Prior Art

It is noted the shipping industry is in a state of continuing development as the demand for products and services is being met by an ever-increasing demand for shipped products in view of a perceived shift away from storefront or in-store purchases. The field of packaging art accordingly continues to develop alongside this increased demand for securement of products through various package delivery systems. In particular there is a need to better protect package contents as the volume of packages increases and packages move through sort facilities and the like. Although packaging art is well-developed, products that were once routinely purchased by way of a storefront or in-store are now being shipped, and there is a perceived need in the art to accommodate shipment of new product lines and goods as they move from sources to customers. Certain packaging art is briefly discussed hereinafter.

U.S. Pat. No. 8,365,914 ('914 patent), issued to Learn, discloses certain Methods and Systems for Packaging a Product. The '914 patent describes a carton comprising a plurality of adjoined panels that define an interior space, including a front panel and a back panel opposite one another, and a first side panel and a second side panel opposite one another, at least one of which is a movable panel operative for being moved between a first position and a second position. A heat-shrink patch is at least partially joined to the movable panel on a side of the movable panel facing the interior space, which heat-shrink patch is operative for shrinking in response to heat so that shrinking the heat-shrink patch moves the movable panel from the first position to the second position.

U.S. Pat. No. 9,902,550 ('550 patent), issued to Roozrokh, discloses a Box with Six Outwardly Facing Surfaces and at Least One Flap. The '550 patent describes a box having six outwardly facing surfaces comprising a first face spaced apart from a second face, a top face spaced apart from a bottom face, and a left side face substantially parallel to and spaced apart from a right-side face, the surfaces forming an interior space of the box, and at least one flap formed in a first face. The flap is configured for deflection from the surface of the first face into the interior of the box. The box is configured to enclose one or more sheets in an interior of the box, wherein the at least one flap is configured to support the one or more sheets in a position nearer the top face than the bottom face.

U.S. Pat. No. 10,239,653 ('653 patent), issued to Putko, discloses a Flat Foldable Packaging. The '653 patent describes a container having both a one-dimensional configuration before it is formed into its three-dimensional configuration. A blank is used to form the container and is initially flat with a plurality of fold lines. The container includes a base portion with a plurality of edges along its perimeter, a lid portion which is distanced from and parallel to the base portion, and a wall projecting orthogonally from each edge forming a plurality of walls. At least one wall is integrally connected to both the base portion and the lid portion.

U.S. Pat. No. 10,786,002 ('002 patent), issued to Mckinney, discloses a Protective Cigarette Pack Case. The '002 patent describes a protective cigarette pack case having a top portion and a bottom portion whereby the bottom portion can be a unitary piece or can be formed from a front portion and a back portion. The bottom portion is adapted to receive a cigarette hard pack bottom portion and the lid portion is adapted to be inserted onto a cigarette hard pack lid. The bottom portion has protruding ears. The lid portion further has a back panel whereby a bottom edge of the back panel has an inward bend that allows the lid portion to engage the paper on a lid of a cigarette hard pack such that it is held in tight communication. The lid portion utilizes the paper hinge of a hard cigarette pack thereby eliminating the need for any hinged apparatus in the protective cigarette pack case.

U.S. Pat. No. 11,352,164 ('164 patent), issued to Barbieri, et al., discloses a Carton Package and a Blank for a Carton Package. The '164 patent describes a carton package comprising a top panel, a bottom panel, a front panel, a back panel, a left panel, and a right panel separated by four edges. The front panel is connected to the top panel along a front-top edge and is connected to the bottom panel along a front-bottom edge. At a first height, measured from the front-bottom edge, the transversal width of the front panel measured from a front-left edge to a front-right edge is larger than a length of the front-bottom edge, and larger than a length of the front-top edge. At a second height measured from the front-bottom edge, the transversal width of the front panel measured from the front-left edge to the front-right edge is smaller than the length of the front-bottom edge, and smaller than the length of the front-top edge.

U.S. Pat. No. 11,440,282 ('282 patent), issued to Wiley, discloses an Instant Set-Up Bulk Container. The '282 patent describes a foldable container moveable between a stowed configuration and a deployed configuration defining an interior area for holding bulk material. The container includes opposed side panels and a bottom flap extending from a bottom edge of each side panel. A tab member extends from a distal end of each bottom flap and a tab finger extends from each tab member so as to define a hook at a distal end of each bottom flap. The hooks are interconnected so as to hingedly connect the distal ends of the bottom flaps together, thereby causing the bottom flaps to rotate between their respective stowed and deployed configuration positions as the end panels are translated between their respective stowed and deployed configuration positions. Locking tabs extending from distal ends of end flaps extend into the interior area of the container to secure the container in the deployed configuration.

Having considered state-of-the-art packaging supplies, it is noted the prior art perceives a need for packaging designed with damage-resistant properties for shipping substantially planar articles, particularly items whose value is substantially vulnerable to corner damage such as rare and collectible vinyl record sleeves, books, photographs, prints, cards, and artwork. State-of-the-art packaging boxes tend to be subjected to a great deal of wear and tear as they move through sort facilities; and relatively fragile substantially planar articles as exemplified by vinyl records tend to suffer from corner damage in particular as boxes are unloaded, sorted, and reloaded in cramped delivery vehicles and high-volume sorting systems.

The need for damage-resistant packaging is of critical need to retailers and manufacturers that incur significant costs from customer returns when shipped goods are damaged in transit. For e-commerce businesses, whose return rates average between 20% and 30%, which is more than double the 9% traditional retail return rate, the need for quality packaging to reduce the number of damaged products is of particular importance to profitability and brand reliability. Costs incurred from damaged shipments include the cost of replacement item, cost of replacement packaging, shipping costs for returning the damaged item and sending out a replacement item, customer service labor costs for processing returns and exchanges, warehouse labor costs for fulfilling replacement orders, and the loss of future revenue from unsatisfied customers. The costs are even greater when the items damaged in transit are rare, hard-to-replace collectibles such as vintage or limited-edition vinyl records, with corner damage reducing the value thereof by an estimated 10-25%.

Perhaps the greatest cost to a business incurred from damaged shipments is the loss of repeat business from customers and damage to the brand's reputation, particularly for e-commerce businesses whose reputations are built on reliably delivering goods to their customers. In a 2016 study conducted by Package Insight, an overwhelming 73% of participants indicated that they would be unlikely to purchase from a company again after receiving a damaged item. Additionally, the capability to protect goods was ranked as the "most important" characteristic of the packaging materials used to ship items, compared sustainability and ease of product removal, by 80% of participants.

To help reduce shipping and packaging costs and help prevent losses due to damaged goods as shipped through package delivery systems, the present invention was conceived. Accordingly, the prior art perceives a need for a packaging box blank and configurable packaging box outfitted with certain damage-resistant features as summarized in more detail hereafter.

SUMMARY OF THE INVENTION

As prefaced above, a primary objective of the present invention is the provision of a damage-resistant packaging box for shipping substantially planar articles as exemplified by vinyl records and other similarly shaped products/goods. To achieve this primary objective, the damage-resistant packaging box according to the present invention essentially comprises a base box portion, a pair of opposed side wall flap portions, and a pair of opposed top flap portions.

The base box portion, opposed side wall flap portions, and opposed top flap portions are particularly formed to provide a series of box top and box bottom corner extension features when the packaging box blank is reconfigured into the form of a packaging box for article shipment.

The base box portion comprises opposed side wall attachment portions, opposed top flap attachment portions, and opposed pairs of box bottom corner extensions. The opposed side wall attachment portions each comprise a side wall attachment length and the opposed top flap attachment portions each comprise a top flap attachment length. In certain preferred embodiments, the side wall attachment length is less than the top flap attachment length. The opposed pairs of box bottom corner extensions extend obliquely and outwardly relative to the opposed side wall attachment portions.

In certain preferred embodiments, the pair of opposed side wall flap portions extend laterally from the opposed side wall attachment portions and each comprise an outer side flap terminal edge, opposed side flap edges, opposed oblique side flap edges, a side flap inner first fold line, and a side flap outer second fold line. The opposed oblique side flap edges extend obliquely relative to the opposed inner first fold lines and the opposed side flap edges. The pair of opposed top flap portions extend longitudinally from the opposed top flap attachment portions and each comprise an outer top flap terminal edge, opposed inner top flap side edges, opposed oblique top flap edges, opposed outer top flap side edges, a top flap inner first fold line and a top flap outer second fold line. The opposed oblique top flap edges extend obliquely relative to the opposed inner top flap side edges and the opposed outer top flap side edges.

To enclose or package a substantially planar or flat article, the pair of opposed side wall flap portions are firstly folded along the side flap inner first fold lines and secondly folded along the side flap outer second fold lines. The pair of opposed side wall flap portions thereby cover laterally opposed portions of an article received in anterior adjacency to the base box portion. The pair of opposed top flap portions are then sequentially firstly folded along the top flap inner first fold lines and secondly folded along the top flap outer second fold lines. The pair of opposed top flap portions thereby cover longitudinally opposed portions of the article received in anterior adjacency to the base box portion. In some embodiments, a second top flap portion of the pair of opposed top flap portions overlaps a first top flap portion of the pair of opposed top flap portions. In some embodiments, the first and second top flap portions do not overlap, but are configured to close the box such that opposed outer top flap edges of the first and second top flap portions meet at an upper box seam and are coplanar when the box is finally closed or sealed. The opposed outer top flap edges and the opposed oblique top flap edges together provide opposed pairs of box top corner extensions. The box top corner extensions preferably extend in parallel relation to the opposed pairs of box bottom corner extensions.

The packaging box may then be outfitted with a length of adhesive tape material over the second and first top flap portions, or alternatively, an adhesive material under the second top flap portion in those embodiments where the second top flap portion overlaps with the first top flap portion. In other words, the length of adhesive tape material, whether applied over the first and second top flap portions, or alternatively with an adhesive to secure the second top flap portion to the first top flat portion thereby providing a sealed packaging box. A select top flap portion may optionally comprises a perforated pull tab for enabling a user to open the sealed packaging box, whereby the select top flap portion is selected from the group comprising the first top flap portion and the second top flap portion.

The side flap inner first fold lines and the side flap outer second fold lines define laterally opposed box side wall portions; and the top flap inner first fold lines and the top flap outer second fold lines define longitudinally opposed box side wall portions. The laterally opposed box side wall portions and the longitudinally opposed box side wall portions together define an outer packaging box thickness. The pair of opposed side wall flap portions and the base box portion define an inner packaging box thickness, which inner packaging box thickness is preferably configured to receive an article thickness in anterior adjacency to the base box portion.

Stated another way, the damage-resistant packaging box according to the present invention preferably comprises a primary article-containing package portion, a series or integrally and particularly formed corner extensions, and a package closure mechanism. The primary article-containing packaging portion comprises a package length, a package width, a package depth, interior package surfacing, exterior package surfacing, and a series of package corners. The package length and the package width are preferably greater in dimension than the package depth.

The series of integrally formed corner extensions extend laterally outwardly from the article-containing package at the external package surfacing for providing package-strengthening and/or impact-absorbing structure at the series of package corners. The package closure mechanism enables a shipper user to insert an article into the primary article-containing package portion and further enables the shipper user to close the primary article-containing package portion for article shipment. The series of corner extensions comprise a first set of corner extensions at a first lateral side of the packaging box and a second set of corner extensions at a second lateral side of the packaging box. The first and second sets of corner extensions preferably extend in opposite directions.

The series of corner extensions each preferably comprise an anterior extension section, a posterior extension section, and a central extension section. The anterior extension sections are coextensive with an anterior package portion, the posterior extension sections are coextensive with a posterior package section, and the central extension sections are coextensive with side wall sections. Each anterior extension section is preferably in the form of a right trapezoid; each posterior extension section is preferably in the form of a right triangle; and each central extension section is preferably in the form of a rectangle. Each anterior extension section is orthogonally connected to the central extension section at an anterior junction site and the posterior extension section is orthogonally connected to the central extension section at a posterior junction site.

BRIEF DESCRIPTIONS OF THE DRAWINGS

Other features and objectives of our invention will become more evident from a consideration of the following brief descriptions of patent drawings.

Figure 10:
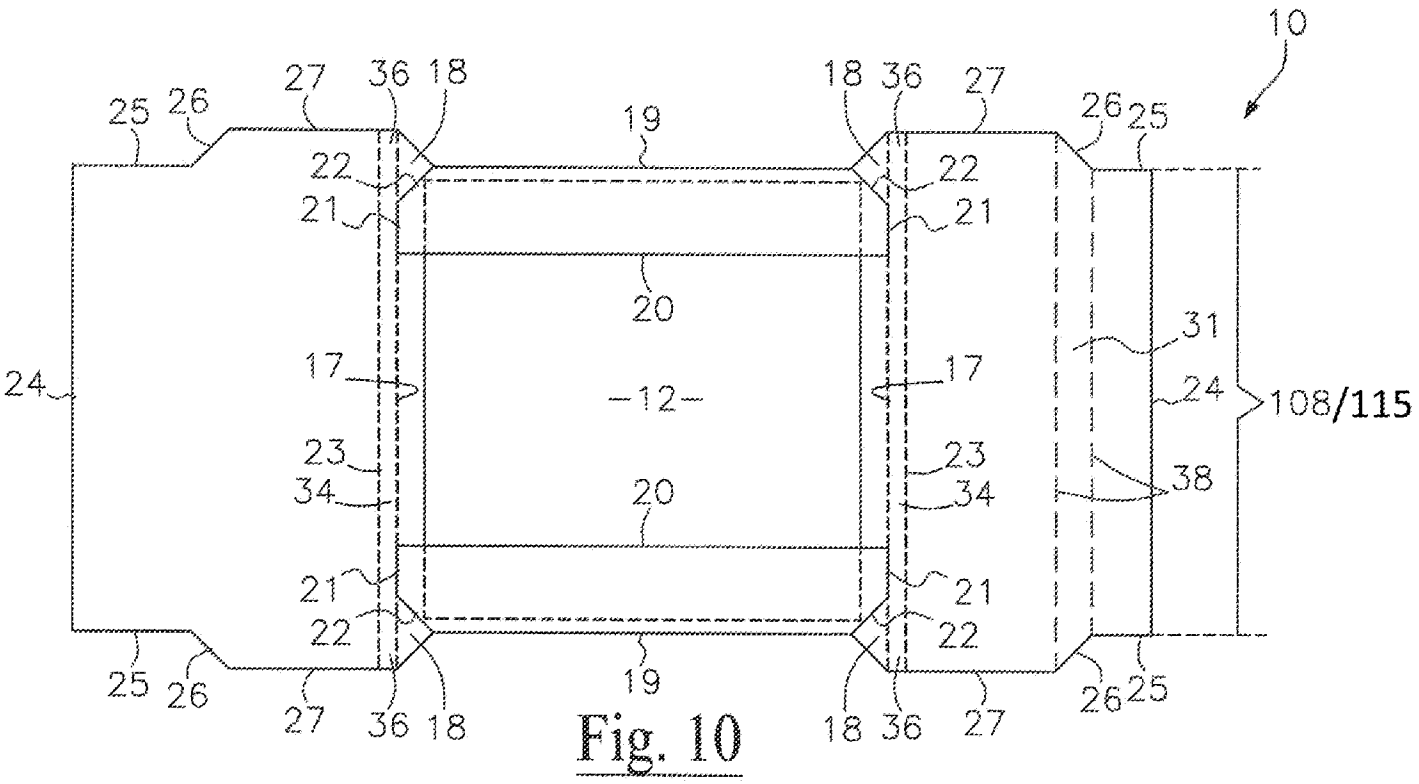

FIG. 10 is a second sequential top or anterior plan view of the packaging box blank shown in a firstly folded packaging state configured to show a pair of laterally opposed side wall flap portions folded about laterally opposed side flap inner first fold lines and laterally opposed side flap outer second fold lines to cover laterally opposed portions of the substantially planar article positioned in anterior adjacency to the base box portion.

Figure 10A:
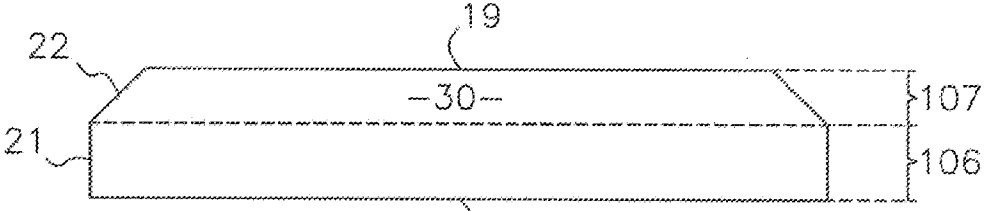

FIG. 10A is a sectional view as sectioned from FIG. 10 to depict in greater clarity a first side wall flap portion folded about an inner first fold line and a side flap outer second fold line to cover a first lateral portion of the substantially planar article positioned in anterior adjacency to the base box portion.

Figure 11A:
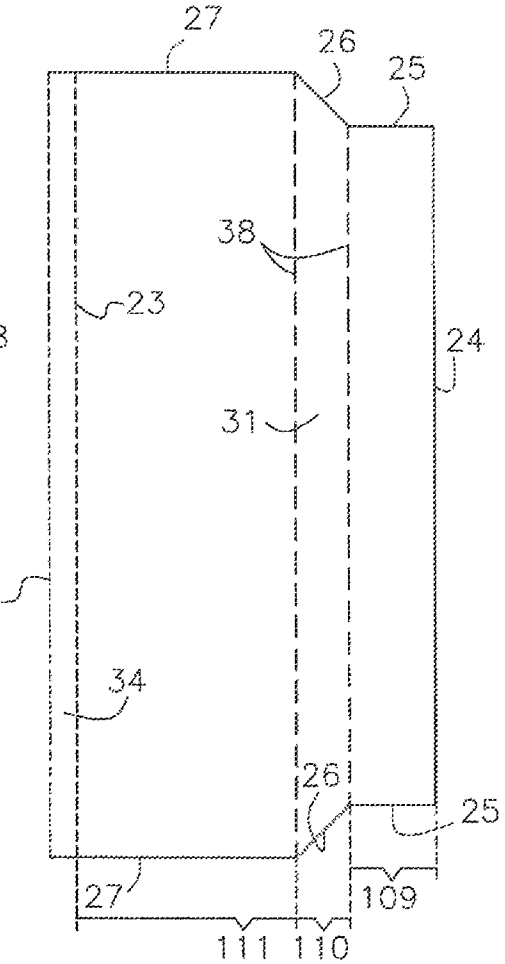
Figure 11:
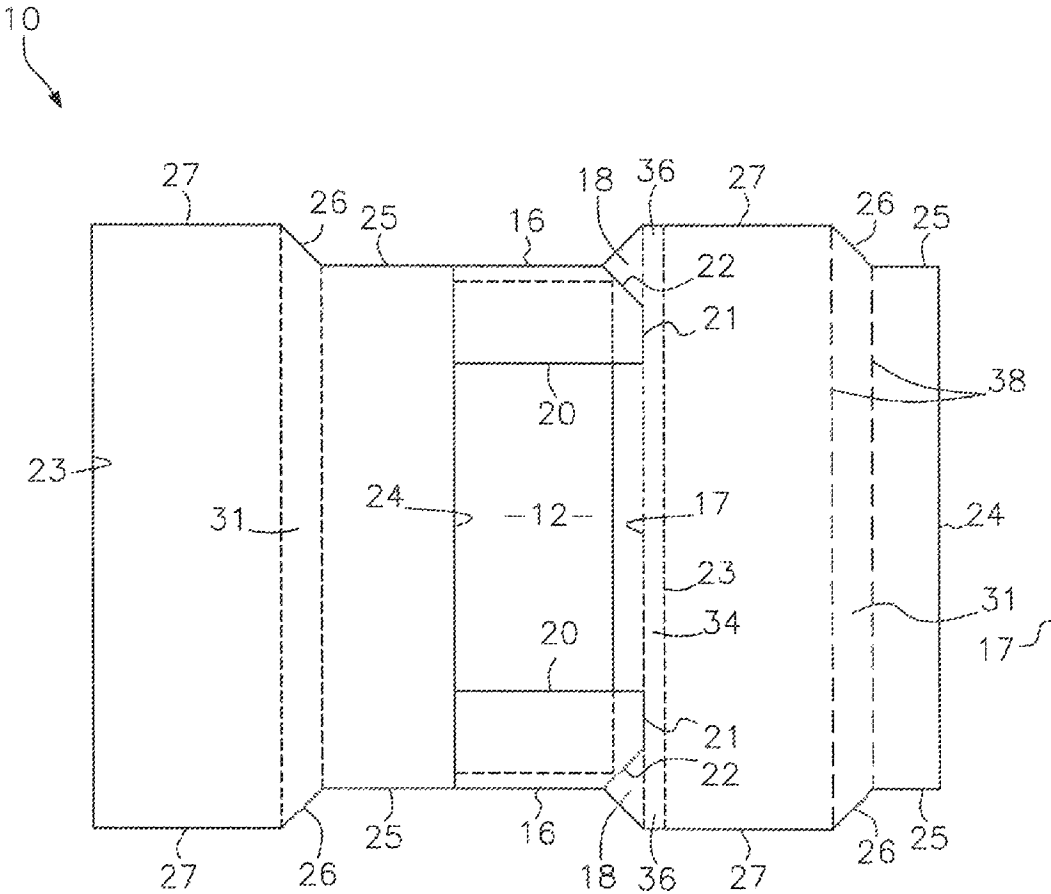

FIG. 11 is a third sequential top or anterior plan view of the packaging box blank shown in a secondly folded packaging state configured to show a first top flap portion folded about a first top flap inner fold line and a first top flap outer fold line to cover a first longitudinal end portion of the substantially planar article positioned in anterior adjacency to the base box portion.

FIG. 11A is an enlarged sectional view as sectioned from FIG. 11 to depict in greater clarity a second top flap portion before being folded about a second top flap inner first fold line and a second top flap outer fold line to cover a second longitudinal end portion of the substantially planar article positioned in anterior adjacency to the base box portion.

Figure 12:
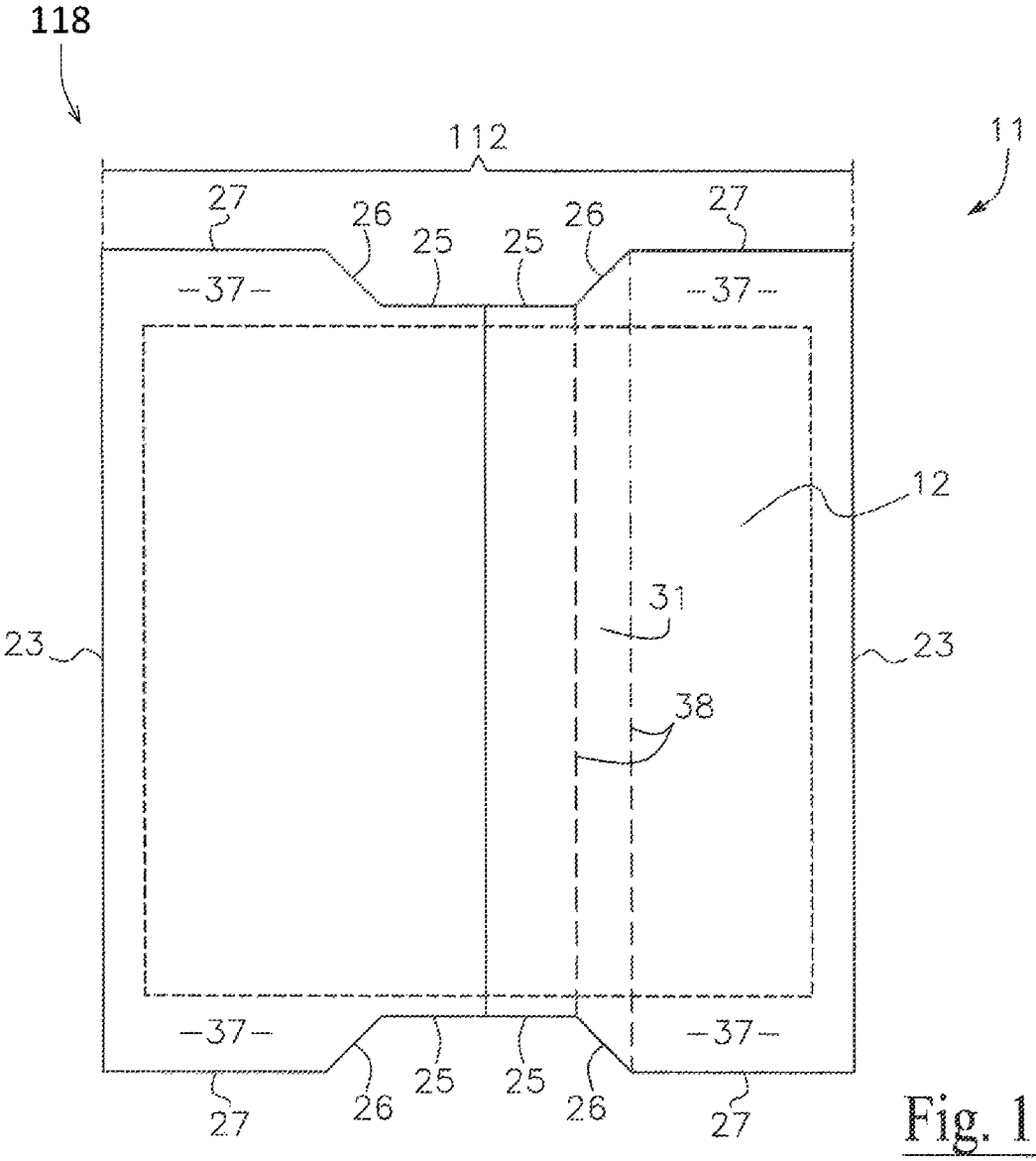

FIG. 12 is a fourth sequential top or anterior plan view of the damage-resistant packaging box according to the present invention showing the second top flap portion folded about the second top flap inner first fold line and the second top flap outer fold line thereby covering the second longitudinal end portion of the substantially planar article.

Figure 13:
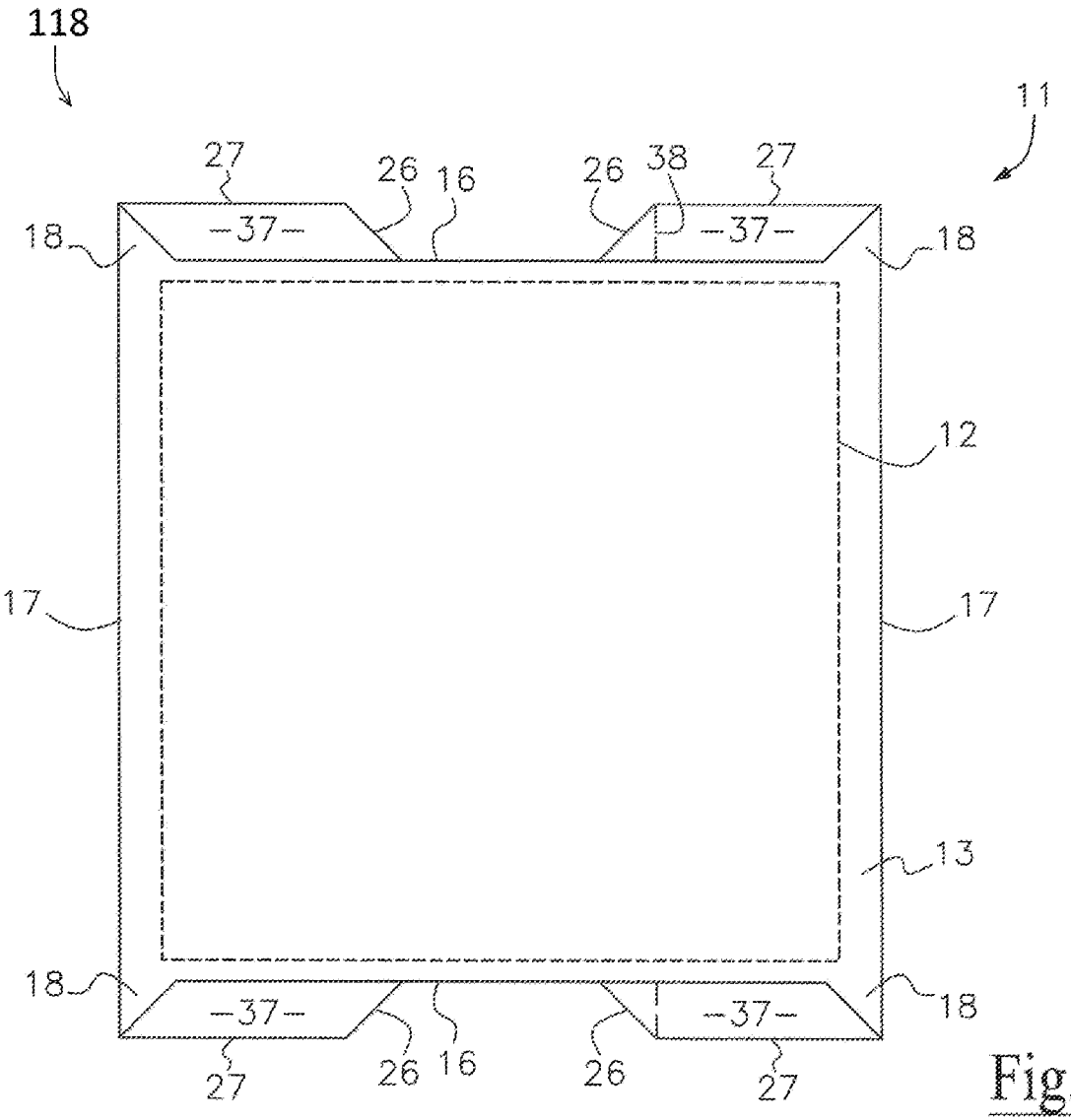

FIG. 13 is a bottom or posterior plan view of the damage-resistant packaging box according to the present invention depicting a hidden, package-enclosed substantially planar article as received within the damage-resistant packaging box.

Figure 5:
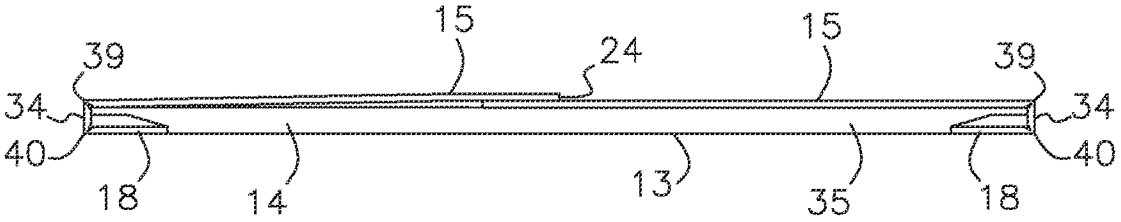
FIG. 5 is a first lateral edge view of the damage-resistant packaging box in a closed configuration according to the present invention.

FIG. 14 is an enlarged first lateral edge view of the damage-resistant packaging box as otherwise depicted in FIG. 5.

FIG. 14A is an enlarged, fragmentary sectional view as enlarged and sectioned from FIG. 14 to depict in greater clarity a first longitudinal end of the damage-resistant packaging box.

Figure 6:
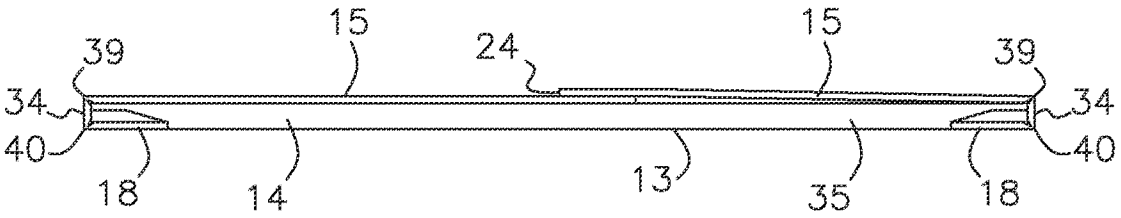
FIG. 6 is a second lateral edge view of the damage-resistant packaging box in a closed configuration according to the present invention.

FIG. 15 is an enlarged second lateral edge view of the damage-resistant packaging box otherwise depicted in FIG. 6.

FIG. 15A is an enlarged, fragmentary sectional view as enlarged and sectioned from FIG. to depict in greater clarity a second longitudinal end of the damage-resistant packaging box.

Figure 16:
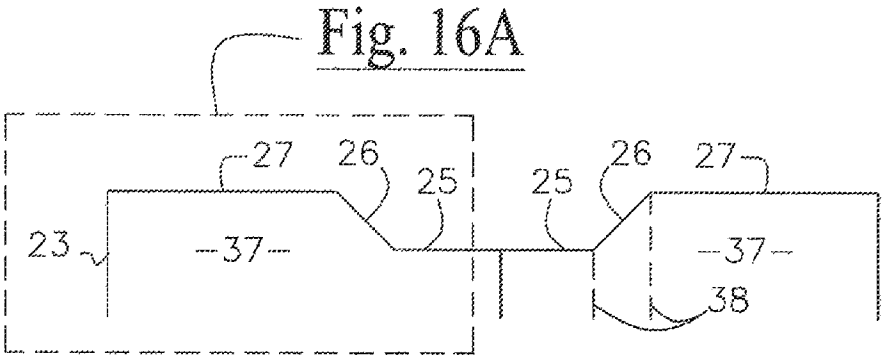

FIG. 16 is a fragmentary top or anterior view of a lateral edge of the damage-resistant packaging box according to the present invention.

Figure 16A:
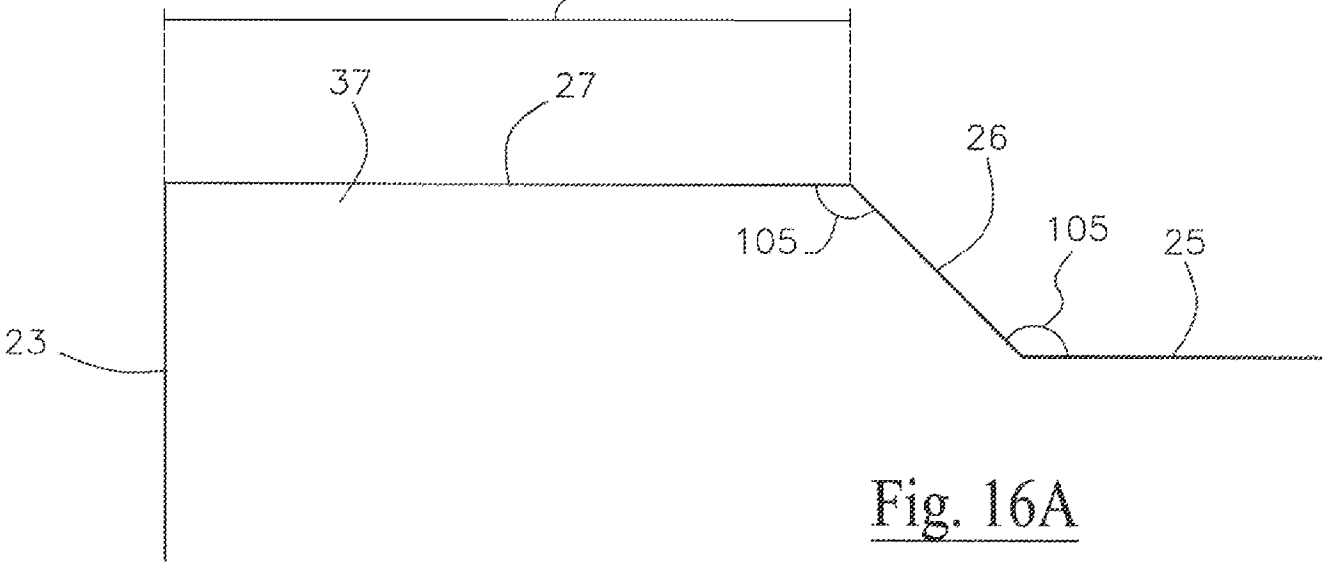

FIG. 16A is an enlarged, fragmentary sectional view as enlarged and sectioned from FIG. 16 to depict in greater clarity a top or anterior view of a box-strengthening or box-reinforcing box top corner extension of the damage-resistant packaging box.

Figure 17:
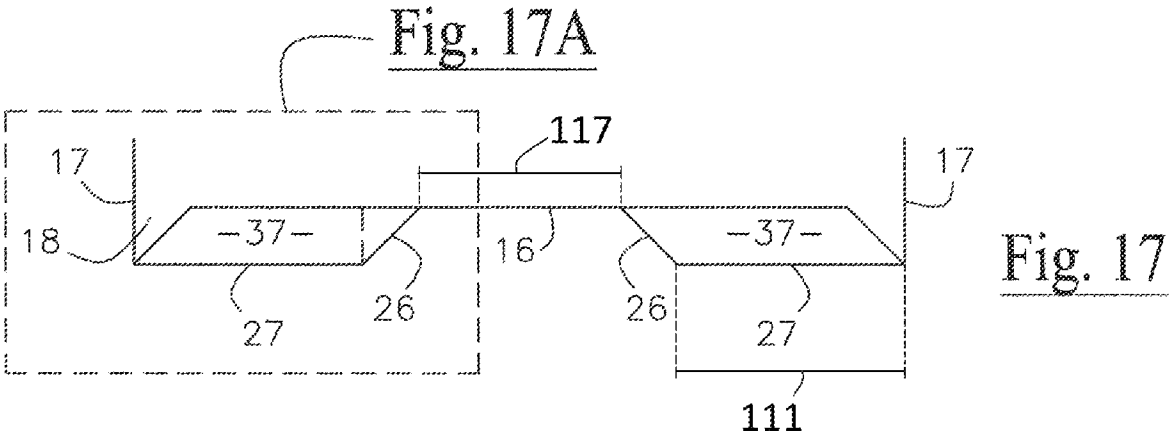

FIG. 17 is a fragmentary bottom or posterior view of a lateral edge of the damage-resistant packaging box according to the present invention.

Figure 17A:
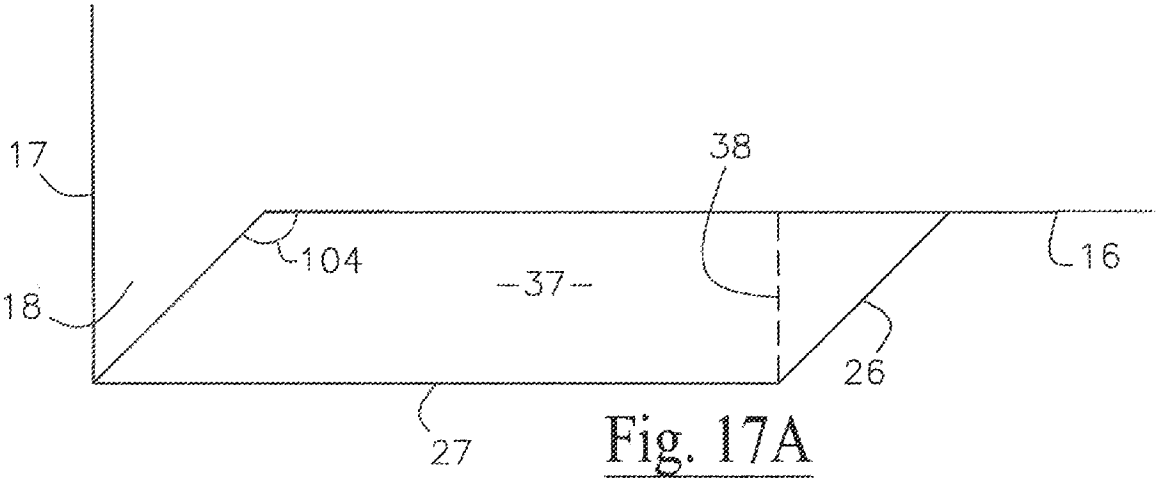

FIG. 17A is an enlarged, fragmentary sectional view as enlarged and sectioned from FIG. 17 to depict in greater clarity a bottom or posterior view of a box-strengthening or box-reinforcing box top corner extension and a box-strengthening or box-reinforcing box bottom corner extension of the damage-resistant packaging box.

Figure 18:
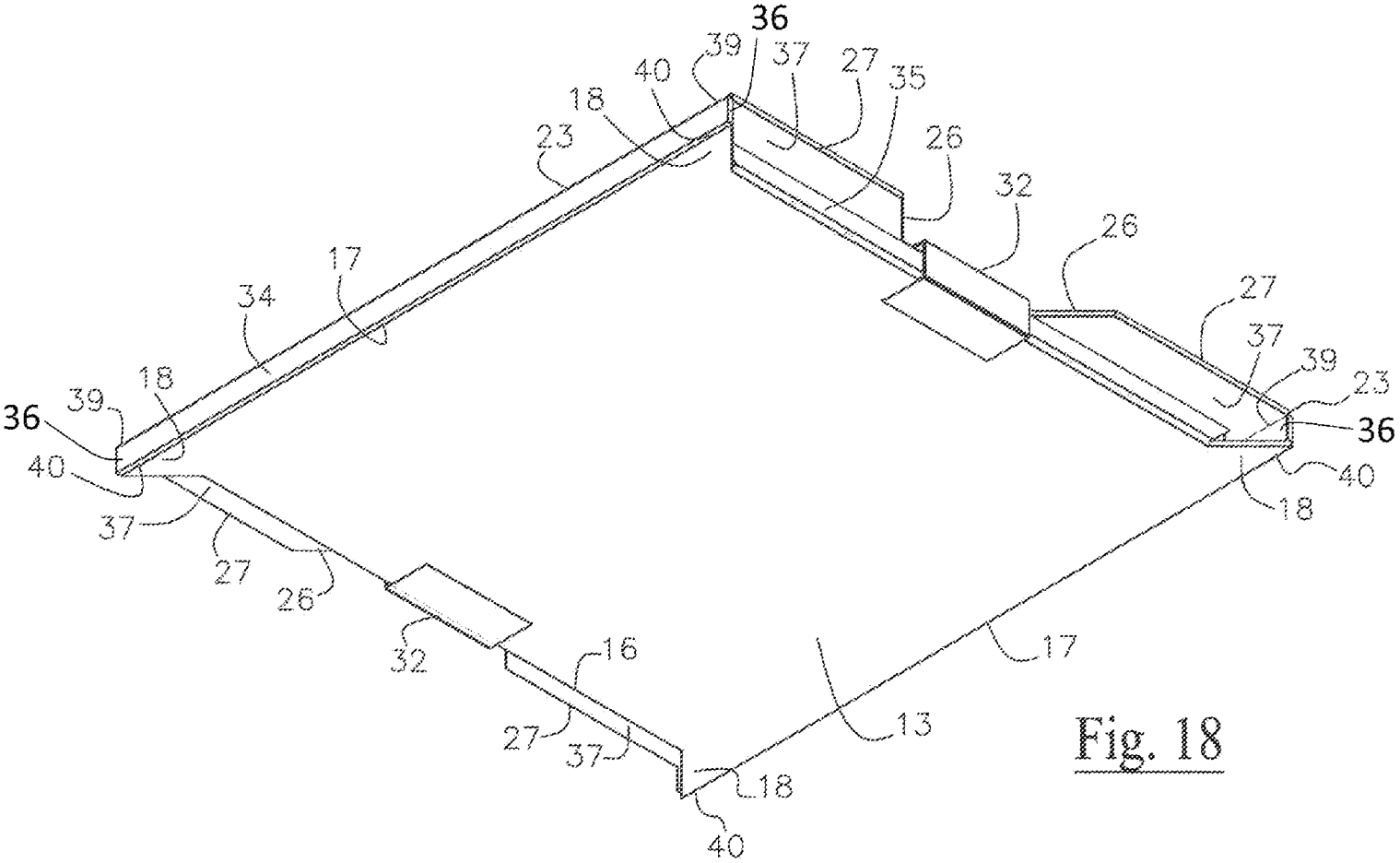

FIG. 18 is a bottom or posterior perspective view of the damage-resistant packaging box according to the present invention.

DETAILED DESCRIPTION OF THE PREFERRED EMBODIMENT

Referring now to the drawings with more specificity, the following specifications generally describe a packaging box blank 10 and configured damage-resistant packaging box 11 for shipping substantially planar articles 12 through package delivery systems from an origination point to a destination point. Having noted that state-of-the-art packaging boxes often result in damage to planar articles, the packaging box 11 according to the present invention is designed to resist damage to articles shipped within the packaging box 11. In a preferred embodiment, the damage-resistant packaging box 11 according to the present invention is designed to ship substantially planar vinyl records as received within an outer sleeve. These and similarly shaped articles 12 typically have a rectangular or square shape having uniform length and width as at 100 and an abbreviated overall article thickness as at 101.

In some embodiments, the packaging box blank 10 and configured packaging box 11 according to the present invention is preferably formed from corrugated cardboard stock material of select thicknesses and flute types and generally attempts to approximate the dimensions of articles 12 to be shipped so as to reduce overall packaging and shipping costs while providing unique packaging features so as to minimize damage to the articles 12 as they move through package delivery systems. In some embodiments, the subject invention can also be formed from non-corrugated, rigid cardboard material. In this regard, a series of corner extension features are integrally formed with the packaging box 11 that function to essentially absorb impact from peripheral packages and objects as the damage-resistant packaging box 11 moves through package delivery systems thereby minimizing damage to articles 12 shipped thereby.

Figures 1, 1A, 1B:
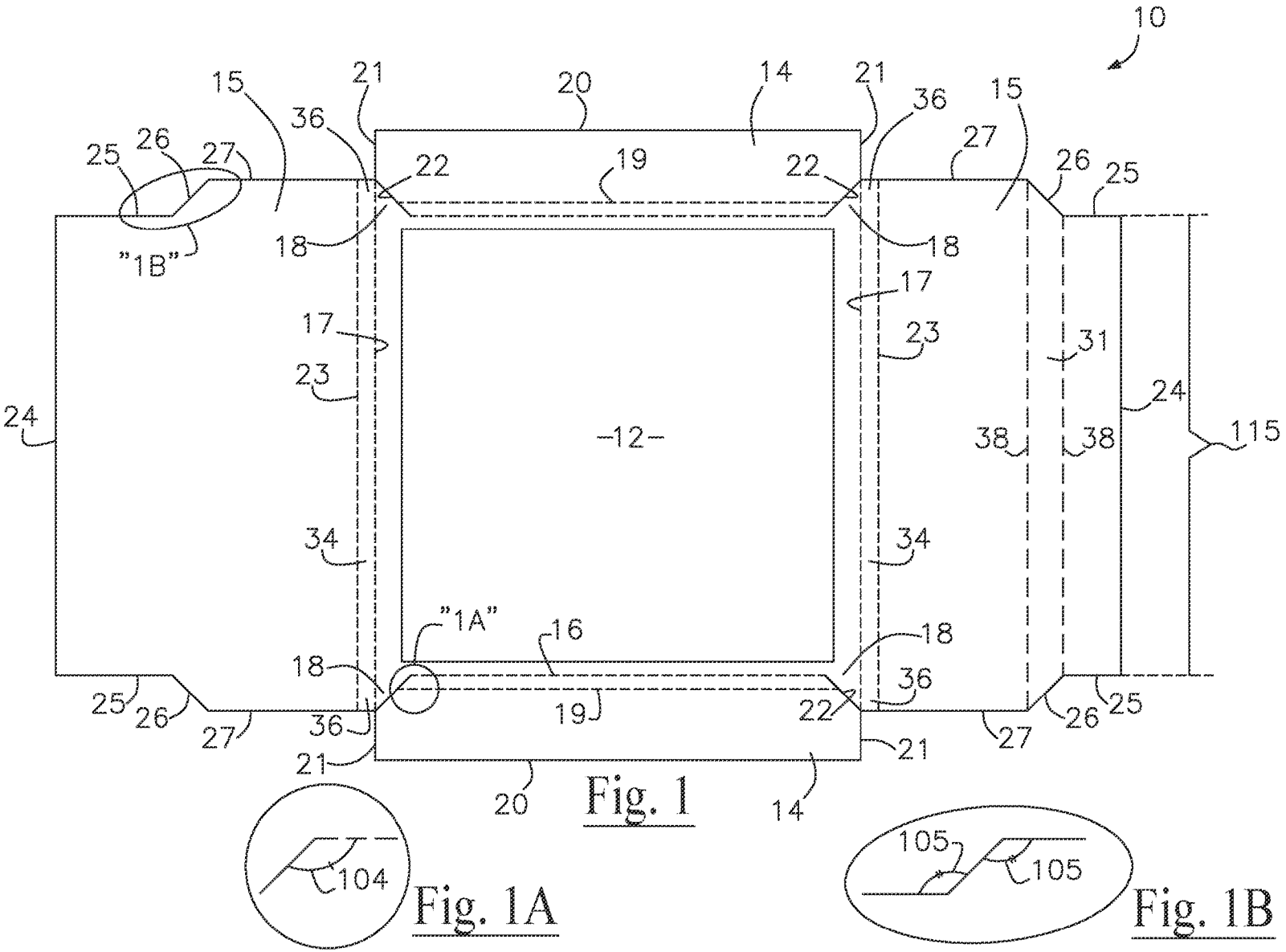
FIG. 1 is a first top or anterior plan view of a packaging box blank configurable into a damage-resistant packaging box according to the present invention.
FIG. 1A is a fragmentary sectional view as sectioned from FIG. 1 to depict in greater clarity an oblique angle at a junction site between a box bottom corner extension and a side flap inner first fold line.
FIG. 1B is a fragmentary sectional view as sectioned from FIG. 1 to depict in greater clarity an oblique top flap edge extending obliquely relative to both an inner top flap side edge and an outer top flap side edge.
Figure 2:
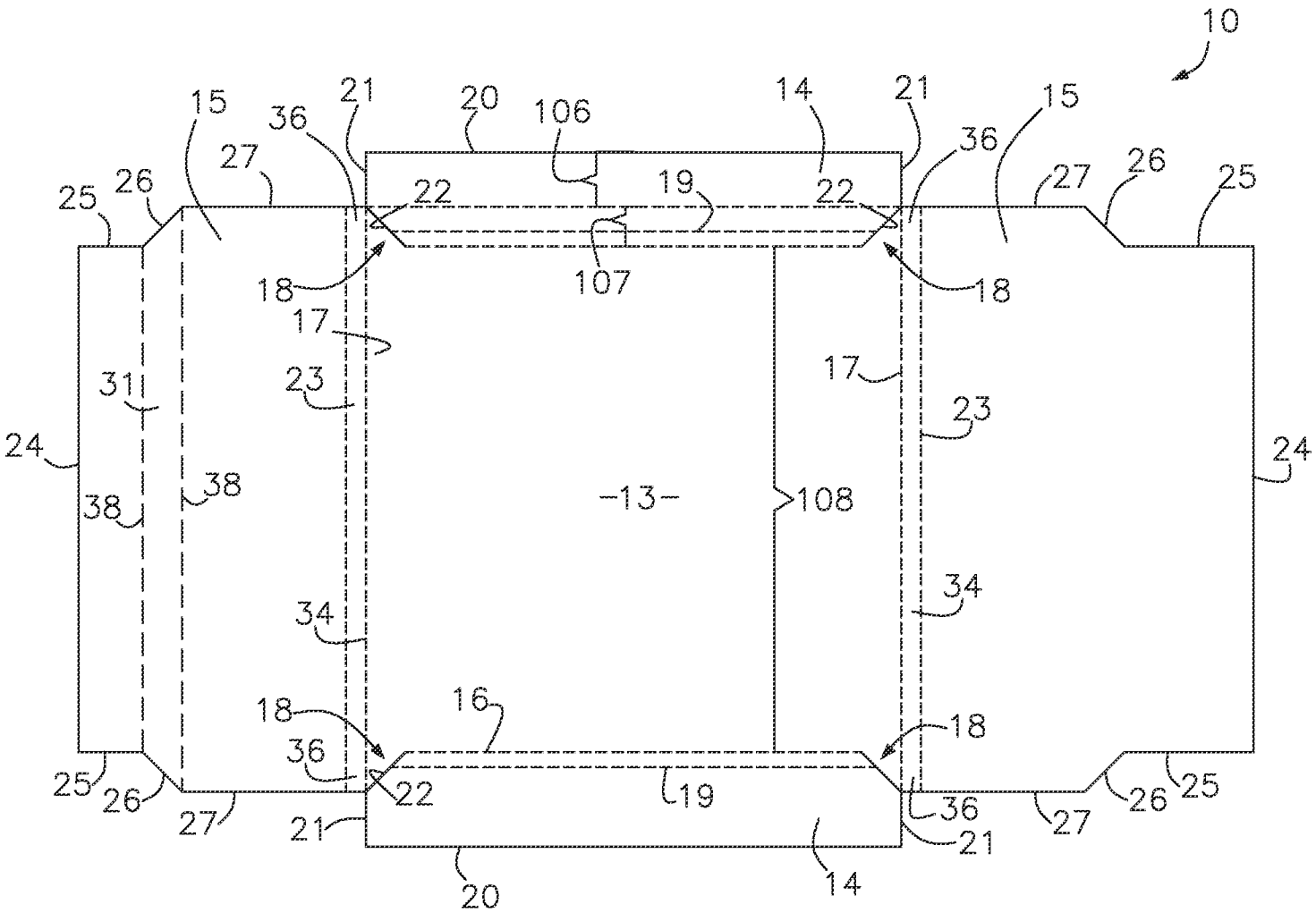
FIG. 2 is a bottom or posterior plan view of the packaging box blank configurable into a damage-resistant packaging box according to the present invention.
Figure 3:
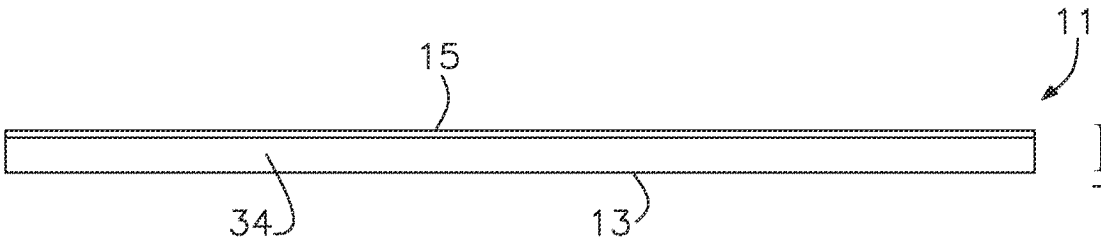
FIG. 3 is a first longitudinal end view of the damage-resistant packaging box in a closed configuration according to the present invention.

To achieve these primary objectives, the packaging box blank 10 according to the present invention preferably comprises a base box portion as at 13, a pair of laterally opposed side wall flap portions as at 14, and a pair of longitudinally opposed top flap portions 15 as generally depicted and referenced in FIGS. 1 and 2. The laterally opposed side wall flap portions 14 are firstly folded to cover laterally opposed portions of the article 12 as received atop or in anterior adjacency to the base box portion 13, and the longitudinally opposed top flap portions 15 are secondly folded to cover longitudinally opposed portions of the article 12 as received atop or in anterior adjacency to the base box portion 13. The base box portion 13, the laterally opposed side wall flap portions 14 and the longitudinally opposed top flap portions 15 are uniquely configured to provide box-strengthening or box-reinforcing box top corner extensions 37 and box bottom corner extensions 18 for resisting damage to the packaging box 11 and the article(s) 12 contained therein as these articles 12 are shipped through package delivery systems.

The base box portion 13 preferably comprises laterally opposed side wall attachment portions or side flap inner first fold lines as at 16; longitudinally opposed top flap attachment portions or top flap inner first fold lines as at 17; and laterally opposed pairs or four triangular box bottom corner extensions as at 18. The laterally opposed side wall attachment portions or side flap inner first fold lines 16 each preferably comprise a side wall attachment length as at 102, and the longitudinally opposed top flap attachment portions or top flap inner first fold lines 17 each preferably comprise a top flap attachment length as at 103. The side wall attachment length 102 is less than the top flap attachment length 103. The laterally opposed pairs of box bottom corner extensions 18 extend obliquely and outwardly relative to the laterally opposed side wall attachment portions or side flap inner first fold lines 16. In a preferred embodiment, the oblique angle of the laterally opposed pairs of box bottom corner extensions 18 is 135 degrees as at angle 104 generally depicted and referenced in FIG. 1A.

The pair of laterally opposed side wall flap portions 14 extend outwardly from the laterally opposed side wall attachment portions and are firstly foldable along the side flap inner first fold lines 16 and secondly foldable along laterally opposed side flap outer second fold lines as at 19. The laterally opposed inner first fold lines 16 at the laterally opposed side wall attachment portions 14 are coextensive with the side wall attachment length 102. The pair of laterally opposed side wall flap portions 14 each further preferably comprise an outer side flap terminal edge as at 20; longitudinally opposed side flap edges as at 21; and longitudinally opposed oblique side flap edges as at 22. The longitudinally opposed oblique side flap edges 22 preferably extend obliquely relative to the laterally opposed inner first fold lines or side wall attachment portions 16 and the longitudinally opposed side flap edges 21. In a preferred embodiment, the oblique angle of the longitudinally opposed oblique side flap edges 22 is 135 degrees as at angle 104 in FIG. 1A.

The pair of longitudinally opposed top flap portions 15 extend outwardly from the longitudinally opposed top flap attachment portions or second fold portions 17 and are firstly foldable along longitudinally opposed top flap inner first fold lines 17. The longitudinally opposed top flap attachment portions or top flap inner first fold lines 17 are secondly foldable along longitudinally opposed top flap outer second fold lines or edges as at 23. The longitudinally opposed inner first fold lines 17 at the longitudinally opposed top flap attachment portions are coextensive with the top flap attachment length 103. The pair of longitudinally opposed top flap portions 15 each further preferably comprise an outer top flap terminal edge as at 24; laterally opposed inner top flap side edges as at 25; laterally opposed oblique top flap edges as at 26; and laterally opposed outer top flap side edges as at 27. The laterally opposed oblique top flap edges 26 preferably extend obliquely at an angle 105 of 135 degrees relative to both the laterally opposed inner top flap side edges 25 and the laterally opposed outer top flap side edges 27 as generally depicted and referenced in FIG. 1B.

To form or configure the damage-resistant packaging box 11 from the packaging box blank 10, the pair of laterally opposed side wall flap portions 14 are firstly folded 90 degrees along the laterally opposed inner first fold lines 16 at the laterally opposed side wall attachment portions 14 and secondly folded 90 degrees along the laterally opposed outer second fold lines 19 as generally depicted in FIG. 10. The longitudinally opposed side flap edges 21 each have a side flap edge length as at 106. The longitudinally opposed oblique side flap edges 22 define non-parallel trapezoidal legs of side flap trapezoidal sections 30 of the laterally opposed side wall flap portions 14. These side flap trapezoidal sections 30 of the laterally opposed side wall flap portions 14 each have a side flap trapezoidal section altitude or height as at 107. The side flap edge length 106 and the side flap trapezoidal section altitude or height 107 are together less than a side wall-to-side wall distance or width 108 for covering laterally opposed portions of the article 12 as received atop or in anterior adjacency to the base box portion 13.

The pair of laterally opposed top flap portions 15 are then firstly folded 90 degrees along the longitudinally opposed inner first fold lines 17 at the longitudinally opposed top flap attachment portions and secondly folded 90 degrees along the longitudinally opposed outer second fold lines 23 as comparatively depicted in FIGS. Nos. 11 and 12. In some embodiments, the laterally opposed inner top flap edges 25 each have an exposed inner top flap edge length as at 109, and the laterally opposed oblique side flap edges 26 define non-parallel trapezoidal legs of top flap trapezoidal sections 31 of the longitudinally opposed top flap portions 15. These top flap trapezoidal sections 31 of the longitudinally opposed top flap portions 15 each have a top flap trapezoidal section altitude or height as at 110. The laterally opposed outer top flap side edges 27 have an outer top flap edge length as at 111.

The inner top flap edge length 109, the top flap trapezoidal section altitude 110, and the outer top flap edge length 111 of a first top flap portion 15 are together greater than half a top wall-to-top wall distance or width 112 for covering a first longitudinally opposed portion of the article 12 as generally depicted in FIG. 11. The inner top flap edge length 109, the top flap trapezoidal section altitude 110, and the outer top flap edge length 111 of a second top flap portion 15 are together preferably equal to half the top wall-to-top wall distance or width 112 for covering a second longitudinally opposed portion of the article 12 and, in some embodiments, overlaps the first top flap portion 15 thereby closing the packaging box 11 as generally depicted in FIG. 12. In some embodiments, the first top flap portion 15 and the second top flap portion 12 do not overlap, but are configured to close the box such that opposed outer top flap terminal edges 24 of the first and second top flap portions 15 meet at an upper box seam and are coplanar when the damage-resistant packaging box 11 is finally closed or sealed. In some embodiments, the seam is equidistant intermediate the longitudinally opposed side walls 34 of the packaging box 11.

Figure 7:
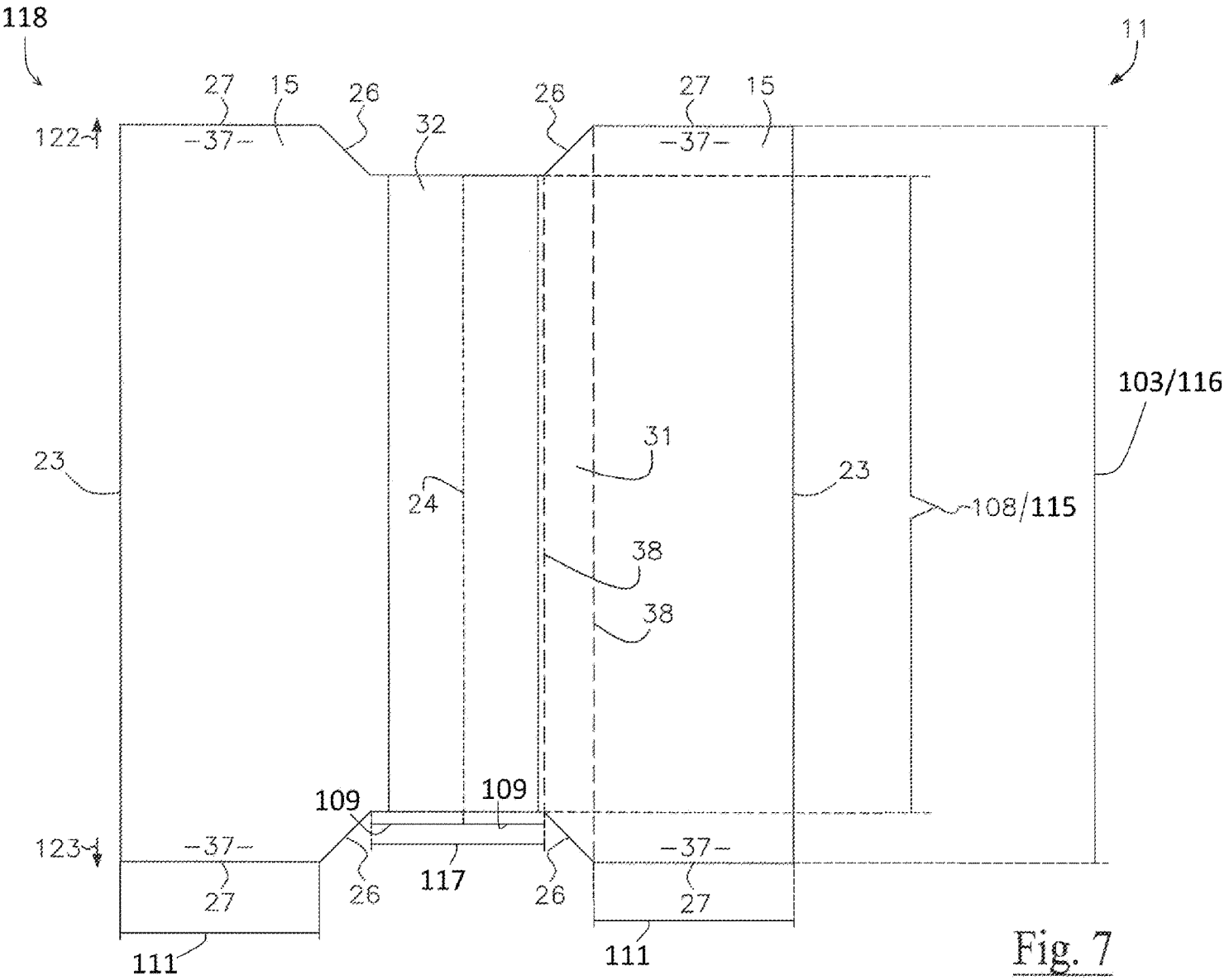
FIG. 7 is a top or anterior plan view of the damage-resistant packaging box according to the present invention.
Figure 8:
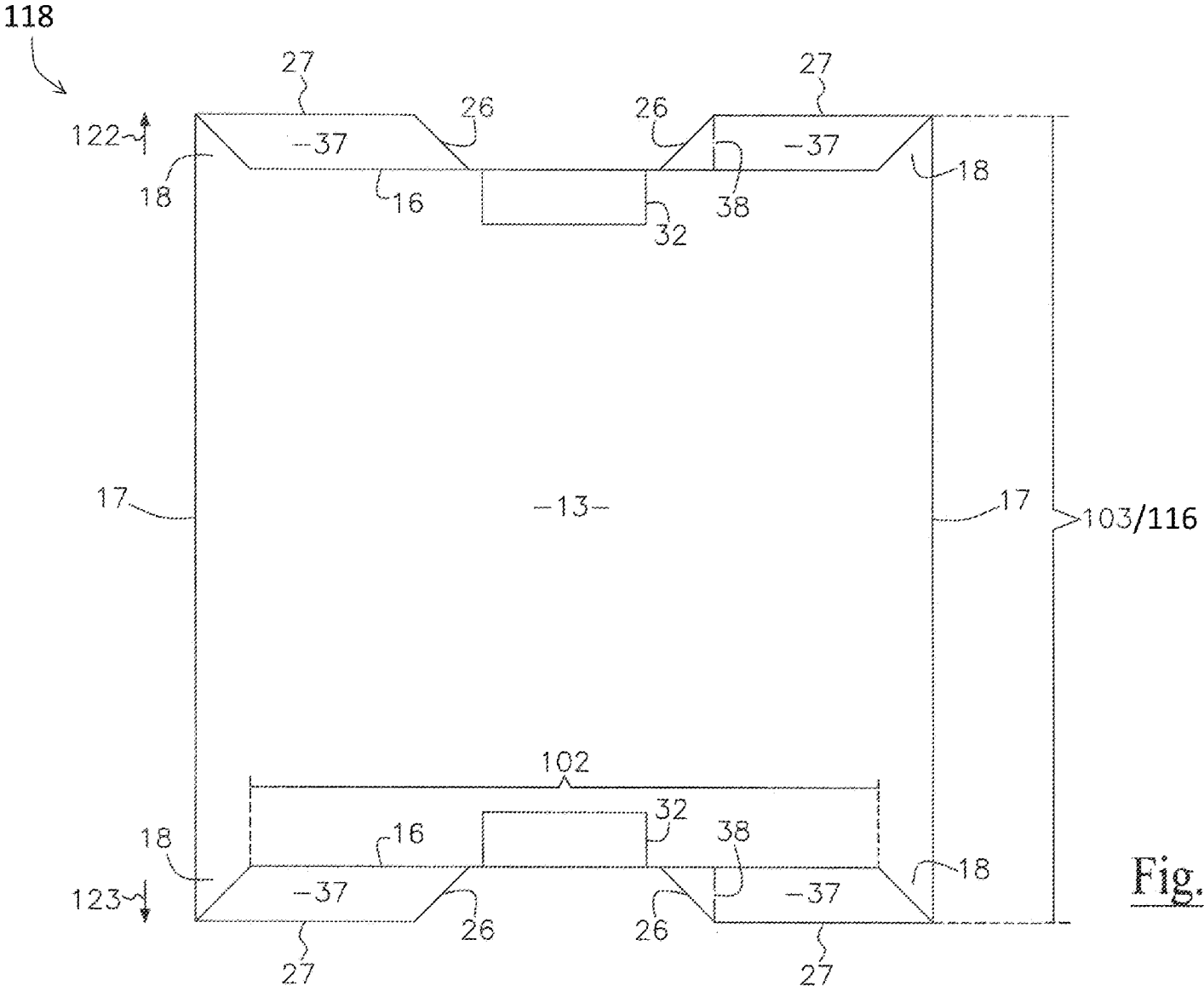
FIG. 8 is a bottom or posterior plan view of the damage-resistant packaging box according to the present invention.
Figure 9:
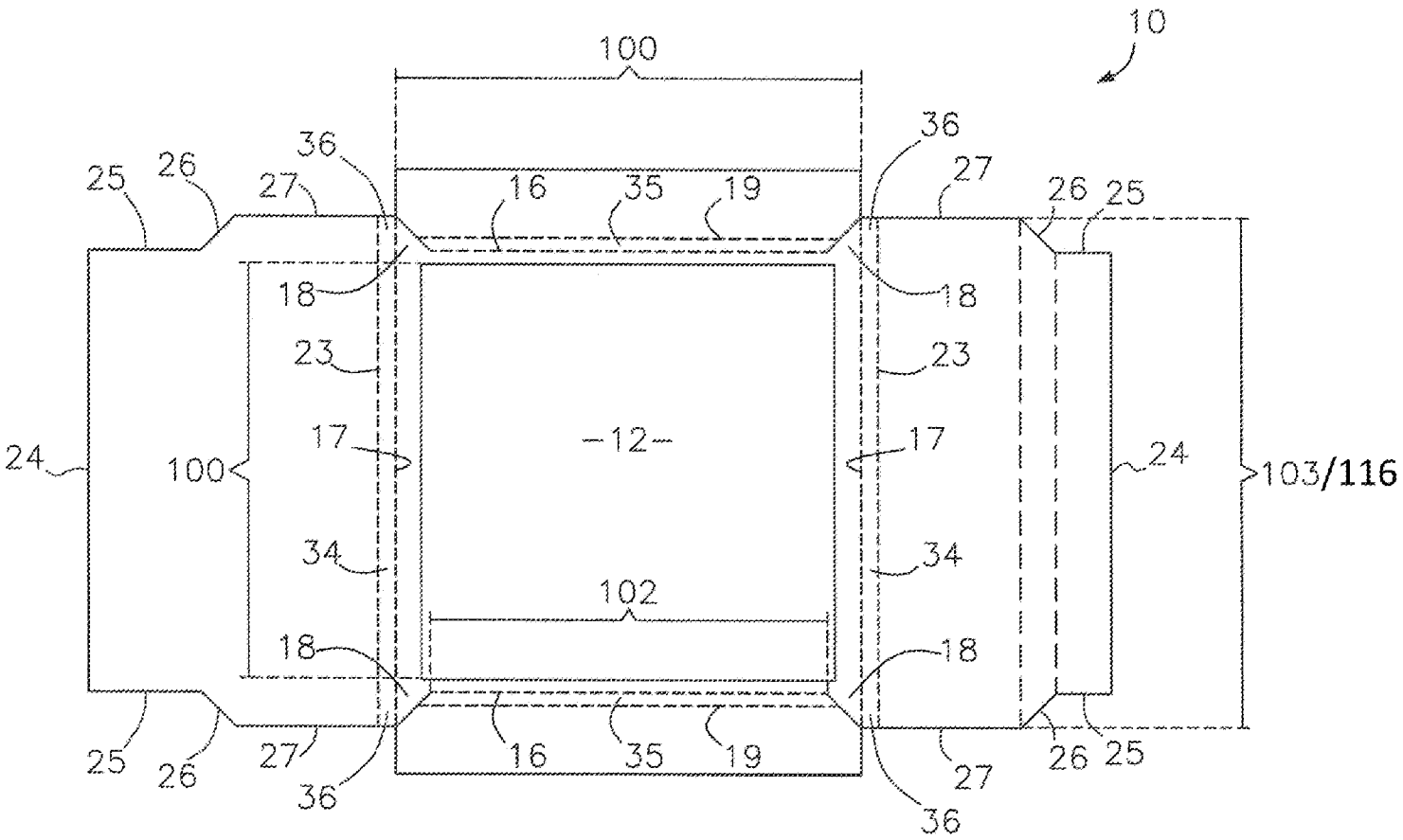
FIG. 9 is a first sequential second top or anterior plan view of the packaging box blank configurable into a damage-resistant packaging box according to the present invention showing a substantially planar article for shipment positioned in anterior adjacency to a base box portion of the packaging box blank.

In some embodiments, a length of adhesive tape material 32 preferably fastens the secondly folded top flap portion 15 in overlapped relation to the firstly folded top flap portion 15 as generally and comparatively depicted in FIGS. 7, 8, and 18. In some embodiments, an adhesive may be applied intermediate the second top flap portion 15 and the first top flap portion at the overlap junction to seal the damage-resistant packaging box 11. The length of tape material 32 seals the packaging box 11 in those embodiments having outer top flap terminal edges 24 of the first and second top flap portions 15 that meet at an upper box seam and are coplanar when the damage-resistant packaging box 11 is finally closed or sealed. At least one of the top flap trapezoidal sections 31 may be perforated along lines 38 for providing a perforated pull tab and enabling package recipients to open the packaging box 11 once fastened with the length of adhesive tape material 32.

Figure 4:
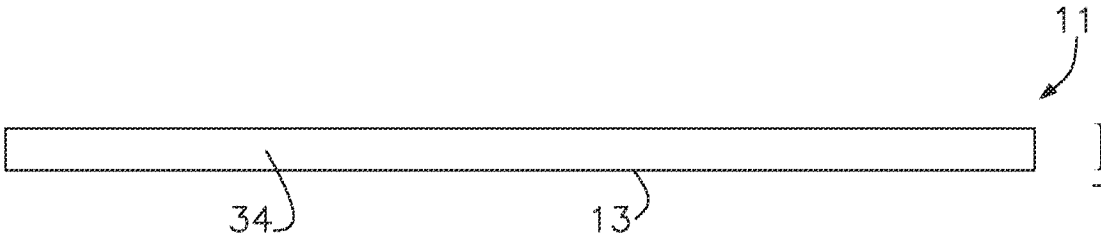
FIG. 4 is a second longitudinal end view of the damage-resistant packaging box in a closed configuration according to the present invention.

The material extending between the longitudinally opposed top flap attachment portions or longitudinally opposed inner first fold lines 17 and the longitudinally opposed outer second fold lines 23 provide longitudinally opposed side walls 34 of the packaging box 11. The material extending between the laterally opposed side wall attachment portions or inner first fold lines 16 and the laterally opposed outer second fold lines 19 provide laterally opposed box side walls 35 of the packaging box 11. The laterally opposed box side walls 35 and the longitudinally opposed box side walls 34 define an outer packaging box thickness as at 113. The laterally opposed side wall flap portions 14 and the base box portion 13 together define an inner packaging box thickness or depth as at 114. The inner packaging box thickness or depth 114 is preferably greater than or equal to the thickness 101 of the article(s) 12 received atop or in anterior adjacency to the base box portion 13. Comparatively referencing FIG. 4A versus FIG. 15A, it will be seen that either a single article 12 of thickness 101 can be shipped by way of the packaging box 11 or multiple articles 12 of thickness 101 can be shipped by way of the packaging box 11.

The laterally opposed outer top flap edges 27 and the laterally opposed oblique top flap edges 26 together provide laterally opposed pairs or four top or anterior corner extensions 37. The laterally opposed pairs of box bottom or posterior box corner extensions 18 and the laterally opposed pairs of box top or anterior box corner extensions 37 together provide laterally opposed pairs of box-reinforcing corner extension features such that the box bottom corner extensions 18 extend in parallel relation to the box top corner extensions 37. Laterally opposed side wall extension portions 36 of the side walls 34 orthogonally interconnect the box bottom or posterior box corner extensions 18 to the box top or anterior box corner extensions 37. The outer top flap terminal edges 24 each comprise a terminal edge length as at 115, which terminal edge length 115 is preferably equal to the side wall-to-side wall length 108. The laterally opposed outer top flap side edges 27 of laterally opposed pairs of box top or anterior box corner extensions 37 comprise an edge-to-edge length 116. The edge-to-edge length 116 is greater than the terminal edge length 115. In some embodiments, the outer top flap edge length 111 of each outer top flap side edge 27 is equal to a combined length 117 of the exposed inner top flap edge lengths 109 of the laterally opposed inner top flap edges 25 as generally depicted in FIG. 7. The box top or anterior box corner extensions 37 thereby provide a bowtie or butterfly shaped configuration 118 of the damage-resistant packaging box 11 when viewed in plan as generally depicted and referenced in FIGS. 7, 8, 12 and 13.

The reader will further see that the damage-resistant packaging box 11 according to the present invention comprises a primary article-containing package portion that receives the substantially planar or flat article(s) 12 to be shipped. The primary article-containing package portion comprises a package length as at 112; a package width as at 108; a package depth as at 113; interior package surfacing as generally depicted in FIG. 1 and referenced at 120; exterior package surfacing as generally depicted in FIG. 2 and referenced at 121; and a series of eight package corners. The primary article-containing package portion is very basically a substantially planar box or box with significantly abbreviated package depth 113 as compared to the package length 112 and package width 108, the package length 112 and the package width 108 being significantly greater than the package depth 113.

A series of corner extensions characterized by box top corner extensions 37 and the box bottom corner extensions extend outwardly from the primary article-containing package portion at the external package surfacing for providing package-strengthening structures or features at the series of eight corners. Referencing the laterally opposed sides of the damage-resistant packaging box 11, it will be seen that a first set of corner extensions are formed at a first lateral side of the packaging box 11 and extend in a first lateral direction as at 122 while a second set of corner extensions are formed at a second lateral side of the packaging box 11 and extend in a second lateral direction as at 123 opposite the first lateral direction 122. More particularly, comparatively referencing FIGS. 7 and 8, it will be seen the first and second sets of corner extensions extend in opposite lateral directions 122 and 123.

Each corner extension feature at each package corner preferably comprises an anterior extension section or box-reinforcing box top corner extension 37; a posterior extension section or box bottom corner extension 18, and a central extension section or side wall extension portion 36. The anterior extension section(s) 37 are coextensive with an anterior package portion otherwise described or defined by the longitudinally opposed top flap portions 15; the posterior extension section(s) 18 are coextensive with a posterior package section otherwise described or defined by the base box portion 13; and the central extension section(s) 36 are coextensive with side wall sections otherwise described or defined by the longitudinally opposed side walls 34. The corner extension features absorb impacts from peripheral packages and objects as the packaging box 11 moves through package delivery systems thereby minimizing damage to articles 12 shipped thereby.

Particularly referencing FIG. 16A it will be seen each anterior extension section or box-reinforcing box top corner extension 37 is in the form of a right trapezoid and particularly referencing FIG. 17A it will be seen each posterior extension section or box bottom corner extension 18 is preferably in the form of a right triangle. Each central extension section or side wall extension portion 36 is preferably in the form of a rectangle and interconnects the anterior extension section(s) 37 to the posterior extension section(s) 18. The obliquely configured portions of the box top corner extensions 37 and the box bottom corner extensions 18 provide a robust, superior impact-dampening structure for resisting impacts to the packaging box 11 as it moves through package delivery systems.

Each anterior extension section or box top corner extension 37 is orthogonally connected to the central extension section 36 at an anterior junction site 39 and each posterior extension section or box bottom corner extension 18 is orthogonally connected to the central extension section 36 at a posterior junction site 40. The laterally opposed side flap portions 14 and the longitudinally opposed top flap portions 15 together provide a package closure mechanism for enabling a user to insert an article 12 into the primary article-containing package portion and for enabling the user to close the primary article-containing package portion for article shipment.

While the above descriptions contain much specificity, this specificity should not be construed as limitations on the scope of the invention, but rather as an exemplification of the invention. In other words, although the inventive damage-resistant packaging box according to the present invention has been described by reference to a number of different features and elements, it is not intended that the novel forms and functions be limited thereby, but that modifications thereof are intended to be included as falling within the broad scope and spirit of the foregoing disclosures, the appended drawings, and the following claims.

We claim:

1. A damage-resistant packaging box for shipping planar articles, the damage-resistant packaging box comprising:

a base box portion, the base box portion comprising opposed side wall attachment portions, opposed top flap attachment portions, and opposed pairs of posterior box corner extensions, the opposed side wall attachment portions each comprising a side wall attachment length, the opposed top flap attachment portions each comprising a top flap attachment length, the side wall attachment length being less than the top flap attachment length, the opposed pairs of posterior box corner extensions extending obliquely and outwardly relative to the opposed side wall attachment portions;

a pair of opposed side wall flap portions extending from the opposed side wall attachment portions, each of the side wall flap portions comprising an outer side flap terminal edge, opposed side flap edges, opposed oblique side flap edges, a side flap inner first fold line, and a side flap outer second fold line, the opposed oblique side flap edges extending obliquely relative to the opposed side flap inner first fold lines and the opposed side flap edges; and a pair of opposed top flap portions extending from the opposed top flap attachment portions, each of top flap portions comprising an outer top flap terminal edge, opposed inner top flap side edges, opposed oblique top flap edges, opposed outer top flap side edges, a top flap inner first fold line and a top flap outer second fold line, the opposed oblique top flap edges extending obliquely relative to the opposed inner top flap side edges and the opposed outer top flap side edges;

the pair of opposed side wall flap portions being firstly folded along the side flap inner first fold lines and secondly folded along the side flap outer second fold lines thereby defining laterally opposed box side walls and the pair of opposed side wall flap portions thereby covering opposed first portions of an article received in anterior adjacency to the base box portion;

the pair of opposed top flap portions being firstly folded along the top flap inner first fold lines and secondly folded along the top flap outer second fold lines thereby defining longitudinally opposed box side walls and the pair of opposed top flap portions thereby covering second opposed portions of the article received in anterior adjacency to the base box portion thereby forming the damage-resistant packaging box;

the damage-resistant packaging box longitudinally opposed side walls each comprising opposed side wall extension portions, the laterally opposed outer top flap edges and the laterally opposed oblique top flap edges together providing laterally opposed pairs of anterior corner extensions terminating centrally relative to the longitudinally opposed box side walls at the laterally opposed inner top flap side edges, each outer top flap portion having an outer top flap edge length equal to a combined exposed length of the laterally opposed inner top flap edges thereby providing a butterfly shaped configuration of the damage-resistant packaging box when viewed in plan;

the opposed pairs of posterior box corner extensions, the opposed pairs of anterior box corner extensions, and the side wall extension portions extending orthogonally outwardly relative to the laterally opposed box side walls thereby providing laterally opposed pairs of three-sided, box-reinforcing corner extension features such that the posterior box corner extensions extend in spaced parallel relation to the anterior box corner extensions, and the opposed side wall extension portions orthogonally interconnect the posterior box corner extensions to the anterior box corner extensions.

2. The damage-resistant packaging box of claim 1 comprising a length of adhesive tape material, the length of adhesive tape material fastening a second top flap portion in overlapped relation relative to a first top flap portion thereby providing a sealed packaging box.

3. The damage-resistant packaging box of claim 2 wherein a select top flap portion comprises a perforated pull tab, the perforated pull tab for enabling a user to open the sealed packaging box, the select top flap portion being selected from the group comprising the first top flap portion and the second top flap portion.

4. The damage-resistant packaging box of claim 1 wherein the opposed oblique top flap edges extend in parallel relation to the posterior box corner extensions and the opposed outer top flap side edges extend in parallel relation to the laterally opposed box side walls.

5. The damage-resistant packaging box of claim 1 wherein the laterally opposed box side wall portions and the longitudinally opposed box side wall portions define an outer packaging box thickness.

6. The damage-resistant packaging box of claim 5 wherein the pair of opposed side wall flap portions and the base box portion define an inner packaging box thickness, the inner packaging box thickness being configured to receive an article thickness in anterior adjacency to the base box portion.

7. The damage-resistant packaging box of claim 4 wherein the outer top flap terminal edges each comprise a terminal edge length, the terminal edge length being equal to a side wall-to-side wall length.

8. The damage-resistant packaging box of claim 7 wherein the opposed outer top flap side edges of the opposed pairs of anterior box corner extensions comprise an edge-to-edge length, the edge-to-edge length being greater than the terminal edge length.

9. A damage-resistant packaging box for shipping planar articles, the damage-resistant packaging box comprising:

a base box portion, the base box portion comprising opposed side wall attachment portions, opposed top flap attachment portions, and a plurality of outwardly extending box bottom corner extensions, the plurality of posterior box corner extensions extending obliquely and outwardly relative to the opposed side wall attachment portions;

opposed side wall flap portions extending from the opposed side wall attachment portions, the opposed side wall flap portions each comprising an outer side flap terminal edge, opposed side flap edges, opposed oblique side flap edges, a side flap inner first fold line, and a side flap outer second fold line, the opposed oblique side flap edges extending obliquely relative to the first fold lines and the opposed side flap edges; and opposed top flap portions, the top flap portions extending from the opposed top flap attachment portions, the opposed top flap portions each comprising an outer top flap terminal edge, opposed inner top flap side edges, opposed oblique top flap edges, opposed outer top flap side edges, a top flap inner first fold line and a top flap outer second fold line, the opposed oblique top flap edges extending obliquely relative to the opposed inner top flap side edges and the opposed outer top flap side edges;

the opposed side wall flap portions being firstly foldable along the opposed inner first fold lines and secondly foldable along opposed outer second fold lines thereby defining a first pair of opposed box side walls and the opposed side wall flap portions thereby covering first opposed portions of an article received in anterior adjacency to the base box portion;

the opposed top flap portions being firstly foldable along the top flap inner first fold lines and secondly foldable along the top flap outer second fold lines thereby defining a second pair opposed box side walls and the opposed top flap portions thereby covering second opposed portions of the article received in anterior adjacency to the base box portion thereby forming the damage-resistant packaging box;

the damage-resistant packaging box each side wall of the first pair of opposed side walls comprising opposed side wall extension portions, the opposed outer top flap edges and the opposed oblique top flap edges together providing a plurality of anterior corner extensions terminating centrally relative to the longitudinally opposed box side walls at the laterally opposed inner top flap side edges thereby providing a butterfly shaped configuration of the damage-resistant packaging box when viewed in plan;

the posterior box corner extensions, the anterior box corner extensions, and the side wall extension portions extending orthogonally outwardly relative to the first pair of opposed side walls thereby providing opposed pairs of three-sided, box-reinforcing corner extension features such that the posterior box corner extensions extend in spaced parallel relation to the anterior box corner extensions, and the opposed side wall extension portions orthogonally interconnect the posterior box corner extensions to the anterior box corner extensions.

10. The damage-resistant packaging box of claim 9 wherein the opposed oblique top flap edges extend in parallel relation to the posterior box corner extensions and the opposed outer top flap side edges extend in parallel relation to the first pair of opposed box side walls.

11. The damage-resistant packaging box of claim 9 wherein the first pair of opposed box side wall portions and the second pair of opposed box side wall portions define an outer packaging box thickness.

12. The damage-resistant packaging box of claim 11 wherein the opposed side wall flap portions and the base box portion define an inner packaging box thickness, the inner packaging box thickness being configured to receive an article thickness in anterior adjacency to the base box portion.

13. The damage-resistant packaging box of claim 10 wherein the outer top flap terminal edges each comprise a terminal edge length, the terminal edge length being equal to a side wall-to-side wall length.

14. The damage-resistant packaging box of claim 13 wherein the opposed outer top flap side edges of the anterior box corner extensions comprise an edge-to-edge length, the edge-to-edge length being greater than the terminal edge length.

15. A damage-resistant packaging box, the damage-resistant packaging box comprising:

a primary article-containing package portion, the primary article-containing packaging portion comprising a package length, a package width, a package depth, interior package surfacing, exterior package surfacing, and a plurality of package corners, the package length and the package width being greater than the package depth;

a plurality of three-sided, box-reinforcing corner extension features extending orthogonally outwardly from a first pair of opposed box side walls of the article-containing package at the external package surfacing for providing package-strengthening structure at the plurality of package corners; and a package closure mechanism, the package closure mechanism for enabling a user to insert an article into the primary article-containing package portion and for enabling the user to close the primary article-containing package portion for article shipment;

each three-sided, box-reinforcing corner extension feature being characterized by a posterior box corner extension, an anterior box corner extension, and a side wall extension portion, the posterior box corner extension extending in spaced parallel relation to the anterior box corner extension, the side wall extension portion orthogonally interconnecting the posterior box corner extension to the anterior box corner extension the anterior box corner extensions at each of the first pair of opposed box side walls terminating obliquely and centrally relative to one another so as to provide a butterfly shaped configuration of the damage-resistant packaging box when viewed in plan.

16. The damage-resistant packaging box of claim 15 wherein each anterior box corner extension is in the form of a right trapezoid, each posterior box corner extension is in the form of a right triangle, and each side wall extension portion is in the form of a rectangle.

17. The damage-resistant packaging box of claim 16 wherein a first edge of each anterior box corner extension extends in parallel relation to an edge of each posterior box corner extension and a second edge of each anterior box corner extension extends in parallel relation to a posterior box edge at the exterior package surfacing at each three-sided, box-reinforcing corner extension feature.

* * * * *